US006694854B2

(12) United States Patent
Furuya

(10) Patent No.: US 6,694,854 B2
(45) Date of Patent: Feb. 24, 2004

(54) HALF-CUTTING DEVICE AND TAPE PRINTING APPARATUS INCORPORATING SAME

(75) Inventor: Yoshikiyo Furuya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 18 days.

(21) Appl. No.: 09/951,358

(22) Filed: Sep. 12, 2001

(65) Prior Publication Data

US 2002/0066349 A1 Jun. 6, 2002

(30) Foreign Application Priority Data

| | | |
|---|---|---|
| Sep. 29, 2000 | (JP) | 2000-297851 |
| Sep. 29, 2000 | (JP) | 2000-297852 |
| Sep. 29, 2000 | (JP) | 2000-297855 |
| Sep. 29, 2000 | (JP) | 2000-297856 |
| Sep. 29, 2000 | (JP) | 2000-297857 |

(51) Int. Cl.[7] ..... B26D 5/16

(52) U.S. Cl. ..... 83/879; 83/614; 83/563; 83/647

(58) Field of Search ..... 83/879, 614, 563, 83/647

(56) References Cited

U.S. PATENT DOCUMENTS

| | | | | |
|---|---|---|---|---|
| 5,523 A | * | 4/1848 | Markham | 83/414 |
| 907,445 A | * | 12/1908 | Berry | 83/453 |
| 1,211,964 A | * | 1/1917 | Rasmussen | 83/556 |
| 1,665,090 A | * | 4/1928 | Gommel | 83/453 |

FOREIGN PATENT DOCUMENTS

| | | |
|---|---|---|
| JP | 02-286367 | 11/1990 |
| JP | 05-020893 | 3/1993 |
| JP | 08-072425 | 3/1996 |
| JP | 2000-006085 | 1/2000 |
| JP | 2000-024996 | 1/2000 |

* cited by examiner

*Primary Examiner*—Allan N. Shoap
*Assistant Examiner*—John Windmuller
(74) *Attorney, Agent, or Firm*—Hogan & Hartson, LLP

(57) ABSTRACT

There is provided a half-cutting device which makes it possible to attain the energy saving, downsizing of the construction of a tape printing apparatus using the device, and reliable cutting with a beautiful cut, and the tape printing apparatus incorporating the device. A half-cutting mechanism carries out half-cutting on a tape material introduced between the same and a tape-receiving member in a direction of the tape material. A half cutter of the half-cutting mechanism has a cutter blade formed by an angular blade, and performs a cutting operation on the tape material by moving in a direction of the width of the tape material. A cutter moving mechanism causes the half cutter to cyclically move through a cutting wait position, a cutting start position, a cutting completed position, a withdrawn position, and then to the cutting wait position.

7 Claims, 30 Drawing Sheets

HALF-CUTTING DEVICE AND TAPE PRINTING APPARATUS INCORPORATING SAME

BACKGROUND OF THE INVENTION

1. Field of the Invention

The present invention relates to a half-cutting device and a tape printing apparatus incorporating the same.

2. Prior Art

Conventionally, there has been proposed a tape printing apparatus that carries out printing while feeding a tape material in the form of a laminate of a printing tape and a peel-off paper, and a half cutter of the apparatus provides a half-cut portion in the printed portion of the tape material so as to facilitate the peeling of the peel-off paper. The printed portion of the tape material is fully cut to a predetermined length, to thereby produce a label element A conventional half cutter is, as proposed in e.g. Japanese Laid-Open Patent Publication (Kokai) No. 2-286367 and Japanese Laid-Open Utility Model Publication (Kokai) No. 5-20893, employs a force cutting method in which a cutter blade thereof moves perpendicularly (in approaching and leaving directions) with respect to the surface of the tape material, thereby carrying out the cutting operation.

The half cutter based on the force cutting method has its cutting edge of the cutter blade brought into contact with over the whole length in the direction of the width of the tape, and hence has a large contact area. Furthermore, it cuts the tape material by applying shearing pressure thereto, and hence requires a large force to perform the cutting. Therefore, from the view point of energy saving, downsizing of the construction of the apparatus, and neat and reliable cutting, this kind of half cutter is not preferable.

Normally, the half cutter has a cutting mechanism formed by a cutter and a tape-receiving member opposed to each other. Then, the cutter cuts into the tape material from one side of the tape material while the tape-receiving member bears the tape material against the shearing force of the cutter. Particularly, when the half-cutting is carried out, the amount of cutting into the tape material is only slight, and hence the setting of the distance between the cutter and the tape-receiving member is very important. Therefore, the technique of positioning the cutter for accurately setting the distance between the cutter and the tape-receiving member is desired. Further, the cutter blade is usually held by a cutter holder, and carries out cutting operation by a portion protruded from the cutter holder.

As described above, the distance or space interval between the cutter blade and the tape-receiving member arranged opposed to each other is important, but if the accuracy of holding the cutter blade by the cutter holder is low, causing variation in the amount of protrusion of the produced portion of the cutter blade, it is impossible to accurately position the cutter blade with respect to the tape-receiving member. This can cause adverse affects on the half-cutting process.

The cutting mechanism of a cutter device used in such a tape printing apparatus includes one based on a scissors-type method, and one based on a sliding cutting method, in addition to the one based on the force cutting method.

In the case of the cutting mechanism based on the sliding cutting method, the cutter blade cuts into a lateral edge of the tape material by hitting against the same, and therefore, the cutter blade can suffers considerable damage. In the tape printing apparatus and the like, such damage occurring upon initial cutting is repeatedly carried out with intervals of time. This causes the problem of breaking and wear of the cutting edge.

SUMMARY OF THE INVENTION

It is a first object of the invention to provide a half-cutting device which makes it possible to attain the energy saving, downsizing of the construction of a tape printing apparatus using the device, and reliable cutting with a beautiful cut, and the tape printing apparatus incorporating the device.

It is a second object of the invention to provide a half-cutting device which can accurately set a distance between a cutter and a tape-receiving member, and a tape-printing apparatus incorporating the same.

It is a third object of the invention to provide a half-cutting device having a cutter holder which can hold the cutter blade with an accurate amount of protrusion of the cutter blade from the cutter holder, and a tape printing apparatus incorporating the same.

It is a fourth aspect of the invention to provide a half-cutting device which is capable of reducing the breaking or wear of a cutter blade employed in the sliding cutting method, and a tape printing apparatus incorporating the same.

To attain the above objects, according to a first aspect of the invention, there is provided a half-cutting device comprising:

- a half cutter that has a cutter blade formed by an angular blade and moves in a direction of a width of a tape material to perform cutting operation on the tape material;
- a tape-receiving member opposed to the half cutter, with the tape material interposed therebetween, for receiving the tape material being cut; and
- a cutter moving mechanism that causes the half cutter to perform a cyclic operation including a cutting preparation operation in which the half cutter is advanced toward the tape-receiving member from a cutting wait position to a cutting start position, the cutting operation in which the half cutter is moved from the cutting start position to a cutting completed position, a withdrawing operation in which the half cutter is withdrawn from the cutting completed position to a withdrawn position, and a returning operation in which the half cutter is returned from the withdrawn position to the cutting wait position.

According to this half-cutting device, a half cutter performs cutting operation by moving in a direction of the width of the tape material. That is, it cuts the tape material by its sliding motion, and hence compared with the force cutting method type, it can cut off the tape material with a very small force, thereby making it possible to attain energy saving, downsizing of the construction of the tape printing apparatus, and neat and reliable cutting. Further, the half cutter is away from the tape-receiving member except when the cutting operation is performed, which prevents the half cutter from providing interference with mounting of the tape material between the half cutter and the tape-receiving member.

Preferably, the cutting operation is a linear motion carried out in a direction orthogonal to a direction of extension of the tape material.

According to this preferred embodiment, the cutting operation is a linear motion carried out in a direction orthogonal to a direction of extension of the tape material, and hence the cutting distance over which the half cutter moves to perform the cutting is minimum. This enables efficient and reliable cutting operation.

Preferably, the tape material is removably mounted in a tape printing apparatus such that an end of the tape material is inserted between the tape-receiving member and the half cutter from above, and the cutting operation of the half cutter is carried out from a lower side of the tape material to an upper side of the same.

According to this preferred embodiment, the cutting operation of the half cutter is carried out by a motion from the lower side of the tape material to the upper side of the same. The tape material tends to be displaced upward during printing (since the platen roller and the print head has an open top space therebetween). In this case, if the cutting is carried out from the upper side to the lower side, the printing position of the tape material tends to be displaced. However, if the cutting operation performed from the lower side to the upper side, the tape material has already been brought into direct abutment with the top plate of the cartridge case or like that, and hence is not displaced.

Preferably, the cutter moving mechanism includes a slide mechanism for causing the half cutter to carry out the cutting operation and the returning operation, a moving toward-and-away mechanism for causing the half cutter to carry out the cutting preparation operation and the withdrawing operation, and a driving force-transmitting mechanism for transmitting a driving force in a bifurcating manner to the slide mechanism and the moving toward-and-away mechanism to thereby cause the slide mechanism and the moving toward-and-away mechanism to operate in a manner interlocked with each other.

According to this preferred embodiment, the driving force-transmitting mechanism transmits the driving force to the slide mechanism and the moving toward-and-away mechanism in a bifurcating manner, and hence it is possible to cause the half cutter to perform the complicated cyclic motion by simple construction. Further, since the slide mechanism and the moving toward-and-away mechanism are operated in a manner interlocked with each other, it is possible to accurately synchronize the operations of the two mechanisms.

Preferably, the slide mechanism includes a guide shaft arranged in parallel with a tape-receiving surface of the tape-receiving member, for slidably holding the half cutter, and an input arm having an end portion thereof connected to the half cutter and at the same time capable of performing swinging motion about a root portion thereof, the input arm being supplied with a portion of the driving force from the driving force-transmitting mechanism, for performing the swinging motion, and causing the half cutter to slide such that the half cutter is guided by the guide shaft.

Further preferably, the half-cutting device includes a frame, and the moving toward-and-away mechanism includes a support block supporting the guide shaft and at the same time mounted on the frame such that the support block is capable of advancing and withdrawing, and an input plate having one end thereof connected to the support block and another end rotatably connected to the frame, the input plate being supplied with a portion of the driving force from the driving force-transmitting mechanism, thereby causing the guide shaft to approach and withdraw, via the support block.

According to this preferred embodiment, the torque of a single rotary disk can be converted to a swinging motion of the input arm and the input plate, whereby it is possible to perform efficient driving force conversion by simple construction.

Preferably, the input arm is formed with a cranking slot, the input plate being formed with a cam protrusion, and the driving force-transmitting mechanism includes a rotary disk being driven for rotation by the portion of the driving force supplied from a drive source, a cranking protrusion formed on one end face of the rotary disk, and an end face cam groove formed in another end face of the rotary disk, wherein the cranking protrusion performing a rotary motion in accordance with rotation of the rotary disk engages with the cranking slot formed in the input arm to form a swinging cranking mechanism in cooperation with the input arm, and the end face cam groove engages with the cam protrusion formed on the input plate, to form an end face cam mechanism in cooperation with the input plate.

Preferably, a sliding area extending along the guide shaft, on which the half cutter slides, is surrounded by a cutter bar such that the cutter bar covers the sliding area.

According to this preferred embodiment, since the area surrounding the sliding area is covered by the cutter bar, which prevents a foreign matter from entering the slide area.

Preferably the cutter bar is formed with a slit, for permitting a connecting portion connecting between the half cutter and the input arm to slide along the guide shaft.

According to this preferred embodiment, the sliding operation of the cutter bar is not blocked by the cutter bar.

Preferably, the cutter bar has an entry-preventing portion formed on a side thereof toward the tape-receiving member, the entry-preventing portion preventing the tape material from entering the slide area.

According to this preferred embodiment, the entry preventing portion is provided for preventing the tape material from entering the slide area, and hence the sliding operation of the half cutter cannot be obstructed due to jamming of the tape material.

Preferably, the cutter bar a cutter blade-protecting portion protruding toward the tape-receiving member such that the cutter blade-protecting portion overlaps the cutter blade of the half cutter in the cutting wait position.

According to this preferred embodiment, the cutter blade in the cutting wait position is protected by the cutter blade-protecting portion, and hence it is possible to protect the cutter blade from a foreign matter entered from the outside.

Preferably, the tape-receiving member is formed with an escape hole for allowing an end portion of the cutter blade-protecting portion to enter therein.

According to this preferred embodiment, the tape-receiving member is formed with an escape hole for allowing an end portion of the cutter blade-protecting portion to enter therein, and therefore, the half cutter does not offer an obstacle to an approaching motion of the half cutter toward the tape-receiving member.

Particularly to attain the first object, it is preferred that the half-cutting device further includes a tape-retaining member configured to be capable of advancing to and withdrawing from the tape material between an urging position at which the tape-retaining member urges the tape material against the tape-receiving member and a release position at which the tape-retaining member is spaced from the tape material, and an interlocking mechanism for moving the tape-retaining member to the urging position immediately before a start of the cutting operation of the half cutter, and moving the tape-retaining member to the release position immediately after completion of the cutting operation.

According to this preferred embodiment, the half cutter performs cutting operation by moving in a direction of the width of the tape material. That is, it cuts the tape material by its sliding motion, and hence compared with the force cutting method type, it can cut off the tape material with a very small force, thereby making it possible to attain energy saving, downsizing of the construction of the tape printing apparatus, and neat and reliable cutting. Further, the tape-retaining member can fix the tape material by pressing the same against the tape-receiving member. This prevents displacement of the tape material when it is cut, and hence prevents displacement of a printing position of the tape material when it is cut. Furthermore, the half-cutting device includes an interlocking mechanism that moves the tape-retaining member to the urging position immediately before a start of the cutting operation of the half cutter, and moves the tape-retaining member to the release position immediately after completion of the cutting operation. This makes accurate the timing in retaining the tape material and timing in cutting the tape material, thereby enabling reliable cutting operation.

Preferably the interlocking mechanism comprises a cutting operation mechanism for causing the half cutter to perform the cutting operation, a moving toward-and-away mechanism for causing the tape-retaining member to advance from the releasing position to the urging position and withdraw from the urging position to the releasing position, and a driving force-transmitting mechanism for transmitting a driving force supplied from a drive source in a bifurcating manner to the cutting operation mechanism and the moving toward-and-away mechanism.

According to this preferred embodiment, the driving force-transmitting transmits the driving force in a bifurcating manner to the cutting operation mechanism and the moving toward-and-away mechanism, and hence it is possible to cause the half cutter to perform complicated motion by simple construction. Further, the cutting operation mechanism and the moving toward-and-away mechanism are operated in an interlocked manner, which makes it possible to attain accurate synchronization of these mechanisms.

Preferably, the half cutter moves in the direction of the width of the tape material to perform the cutting operation on the tape material, and the cutting operation mechanism includes a guide shaft arranged in parallel with a tape-receiving surface of the tape-receiving member, for slidably holding the half cutter, and an input arm having an end portion thereof connected to the half cutter and at the same time capable of performing swinging motion about a root portion thereof, the input arm being supplied with a portion of the driving force from the driving force-transmitting mechanism, for performing the swinging motion, and causing the half cutter to slide such that the half cutter is guided by the guide shaft.

Preferably, the half-cutting device includes a frame, and the moving toward-and-away mechanism includes a support block supporting the tape-retaining member and at the same time mounted on the frame such that the support block is capable of advancing and withdrawing, and an input plate having one end thereof connected to the support block and another end rotatably connected to the frame, the input plate being supplied with a portion of the driving force from the driving force-transmitting mechanism, thereby causing the guide shaft to approach and withdraw, via the support block.

Preferably, a resilient member is interposed between the tape-retaining member and the support block, the resilient member having resilient properties acting in an approaching/withdrawing direction of the tape-retaining member.

According to this preferred embodiment, the tape-retaining member is in resilient contact with the tape-receiving member, so that displacement and deformation of the tape-receiving member and the tape-retaining member are accommodated to ensure reliable retention of the tape material.

Preferably, the input arm is formed with a cranking slot, the input plate is formed with a cam protrusion, and the driving force-transmitting mechanism includes a rotary disk being driven for rotation by the portion of the driving force supplied from a drive source, a cranking protrusion formed on one end face of the rotary disk, and an end face cam groove formed in another end face of the rotary disk, wherein the cranking protrusion performing a rotary motion in accordance with rotation of the rotary disk engages with the cranking slot formed in the input arm to form a swinging cranking mechanism in cooperation with the input arm, and the end face cam groove engages with the cam protrusion formed on the input plate, to form an end face cam mechanism in cooperation with the input plate.

According to this preferred embodiment, the torque of the rotary disk can be converted to swinging motion of the arm and the input plate, thereby enabling efficient torque conversion by simple construction.

Preferably, the half cutter is supported on the tape-retaining member via the guide shaft.

Particularly to attain the second object, it is preferred that the half-cutting device further includes a blade motion guide arranged in parallel with a tape-receiving surface of the tape-receiving member, for guiding a cutting motion of the half cutter parallel to the tape-receiving surface, and a pair of blade-positioning members arranged at opposite ends of the blade motion guide, respectively, for being pushed against the tape-receiving surface.

According to this preferred embodiment, by causing the blade-positioning members to be abut against the tape-receiving member, whereby it is possible to accurately arrange the cutter blade at a predetermined distance from the tape-receiving surface. Further, since the pair of blade-positioning members abut against the tape-receiving member at two upper and lower locations thereof, even if the tape-receiving member or other structure undergoes deformation, it is possible to secure a stable distance between the cutter blade and the tape-receiving member.

Preferably, the half cutting device includes springs for urging the pair of blade-positioning members toward the tape-receiving member, respectively.

According to this preferred embodiment, the urging force of the springs are transmitted to the cutter via the blade-positioning members and the blade moving guide. This sets the cutter in a floated state, whereby it resiliently bites into the tape material, thereby ensuring a cutting performance with a wide stable operation range, while accommodating variation in rigidity of the tape caused e.g. by different biting (engaging) pressure of the cutter blade due to undulation of the tape material along an undulation of the tape-receiving surface of the tape-receiving member.

Preferably, the half cutting device further includes a tape-retaining block capable of advancing to and withdrawing from the tape-receiving member, the tape-retaining block retaining the tape material being subjected to the half cutting, the each of the blade-positioning members being slidably held by the tape-retaining block, and at the same time, the springs urging the blade-positioning members with one ends thereof abutting against the tape-retaining block.

According to this preferred embodiment, the tape-retaining block causes the tape material to be pushed against the tape-receiving member, whereby the tape material can be fixed in position. This makes it possible to prevent displacement of the tape material when it is being cut, and further displacement of the same after it is cut.

Preferably, the tape-retaining block comprises a tape-retaining member for holding the blade-positioning members, and a support block supporting the tape-retaining member in a state in which the tape-retaining member is urged in an advancing direction, in a manner capable of advancing and withdrawing, and the springs urge the blade-positioning members with one ends thereof abutting against the support block.

According to this preferred embodiment, the tape-retaining member being urged is brought into resilient contact with the tape-receiving member. This causes the tape material to be reliably retained without being affected by an undulation of the tape material along an undulation of the tape-receiving surface of the tape-receiving member. Therefore, it is possible to prevent displacement of the tape material when it is cut, and further displacement of the same after it is cut. Further, the tape-retaining member and the blade-positioning members operate without being influenced by each other since they are urged independently of each other, which enhances the reliability of the performance of each of these members.

Preferably, the tape-receiving surface of the tape-receiving member is formed with a groove extending along a path of movement of the half cutter, where the cutter blade of the half cutter faces via the tape material.

According to this preferred embodiment, the provision of the groove causes the tape material to be pushed into the groove, whereby it is possible to make use of the resilience of the tape material. This makes it possible to maintain stable cutting accuracy even with a variation in the position of the blade point (cutting point).

Particularly to attain the third object, it is preferred that the half cutter includes the cutter blade formed by the angular blade in the form of a thin plate having a generally rectangular shape, and a cutter-holding portion holding the cutter blade, and the cutter-holding portion includes a blade-positioning portion against which abut two sides of the cutter blade adjacent to each other with a blade point of the cutter blade therebetween, and a blade press-fitting and holding portion wherein other two sides of the cutter bladed adjacent to each other are press fitted and held therein.

According to this preferred embodiment, the amount of protrusion of the blade point of the cutter blade can be determined by causing the two sides of the cutter blade adjacent to each other with a blade point of the cutter blade therebetween to be abut against the blade-positioning portion, which makes it possible to accurately set the amount of protrusion of the blade point of the cutter blade. Further, the cutter blade can be firmly held by press-fitting the other two adjacent sides of the cutter blade in the blade press-fitting and holding portion.

Preferably, the cutter-holding portions formed by a mounting recess having a shape generally complementary to the cutter blade exclusive of the blade point.

According to this preferred embodiment, only by placing the cutter on the mounting recess and pressing the cutter blade therein, the cutter blade can be easily caused to be held by the cutter holder.

Preferably, the blade-positioning portion is formed by two internal side walls of the mounting recess.

According to this preferred embodiment, the two sides of the cutter blade adjacent to each other with the blade point therebetween are brought into direct contact with the whole length of the blade-positioning portion, with the exception of the blade point. This makes it possible to set the amount of protrusion of the cutter blade from the cutter holder to a constant value irrespective of variation in the external shape of the cutter blade.

Preferably, the blade press-fitting and holding portion has protruding potions protruding into the mounting recess, and the protruding portions have respective protruding ends thereof deformed such that the protruding ends are crushed, thereby holding the cutter blade in a manner pressing the cutter blade against the blade-positioning portion.

According to this preferred embodiment, by only pushing the cutter blade from above, the protruding portions are crushed to thereby positively hold the cutter blade.

Preferably, the blade press-fitting and holding portion has an escape groove into which escape the crushed protruding end.

According to this preferred embodiment, the crushed portion of the protruding portion escapes into the escape groove, and hence does not prevent the blade press-fitting and holding portion from holding the cutter blade.

Particularly to attaint the fourth object, it is preferred that the cutter blade has a blade point formed to have an obtuse angle.

According to this preferred embodiment, since the cutter blade is formed such that the blade point has an obtuse angle. This prevents the breakage of a cutting edge due to forcible pulling operation of the tape material or like member to be cut, and at the same time increases the stability of the tip of the cutting point, also reducing the wear of the cutting edge. In this connection, if the blade point angle is equal to or smaller than 90 degrees, the cutting edge tends to be broken both during blade machining and during cutting operation.

Preferably, the cutter blade has a cutting edge angle which is not smaller than 20 degrees and at the same time not larger than 50 degrees.

According to this preferred embodiment, the cutter blade is set to have a cutting edge angle which is not smaller than 20 degrees and at the same time not larger than 50 degrees. Therefore, the cutter blade has an increased strength against the breakage of the cutting edge. This is because although the cutting edge angel is basically preferred to be acute, a cutting edge having a more acute i.e. smaller cutting edge angel tends to be more prone to breakage.

Preferably, the cutter blade has an entering angle which is not smaller than 20 degrees and at the same time not larger than 60 degrees.

According to this preferred embodiment, the cutter blade is set to have an entering angle which is not smaller than 20 degrees and at the same time not larger than 60 degrees. This makes excellent the balance between the resistance to cutting and possibility of a deviated cut. If the entering angle is smaller than 20 degrees, the cutting resistance becomes too large, whereas if the same is larger than 60 degrees, a deviated cut may occur.

Preferably, the cutter blade is formed of cemented carbide.

According to this preferred embodiment, the cutter blade is formed of cemented carbide, so that the blade is resistant to chipping of the cutting edge, and wear. An ordinary tool steel easily wears, while ceramics tends to be chipped.

To attain the above objects, according to a second aspect of the invention, there is provided a tape printing apparatus including:

- a half-cutting device, the half-cutting device comprising:
  - a half cutter that has a cutter blade formed by a angular blade and moves in a direction of a width of a tape material to perform cutting operation on the tape material;
  - a tape-receiving member opposed to the half cutter, with the tape material interposed therebetween, for receiving the tape material being cut; and a cutter moving mechanism that causes the half cutter to perform a cyclic operation including a cutting preparation operation in which the half cutter is advanced toward the tape-receiving member from a cutting wait position to a cutting start position, the cutting operation in which the half cutter is moved from the cutting start position to a cutting completed position, a withdrawing operation in which the half cutter is withdrawn from the cutting completed position to a withdrawn position, and a returning operation in which the half cutter is returned from the withdrawn position to the cutting wait position; and a printing device that prints on the tape material.

According to this tape printing apparatus, the advantageous effects as described above concerning the half-cutting device can be obtained.

The above and other objects, features, and advantages of the invention will become more apparent from the following detailed description taken in conjunction with the accompanying drawings.

DETAILED DESCRIPTION OF PREFERRED EMBODIMENT

The invention will now be described in detail with reference to drawings showing a tape printing apparatus according to an embodiment thereof.

Figure 1:
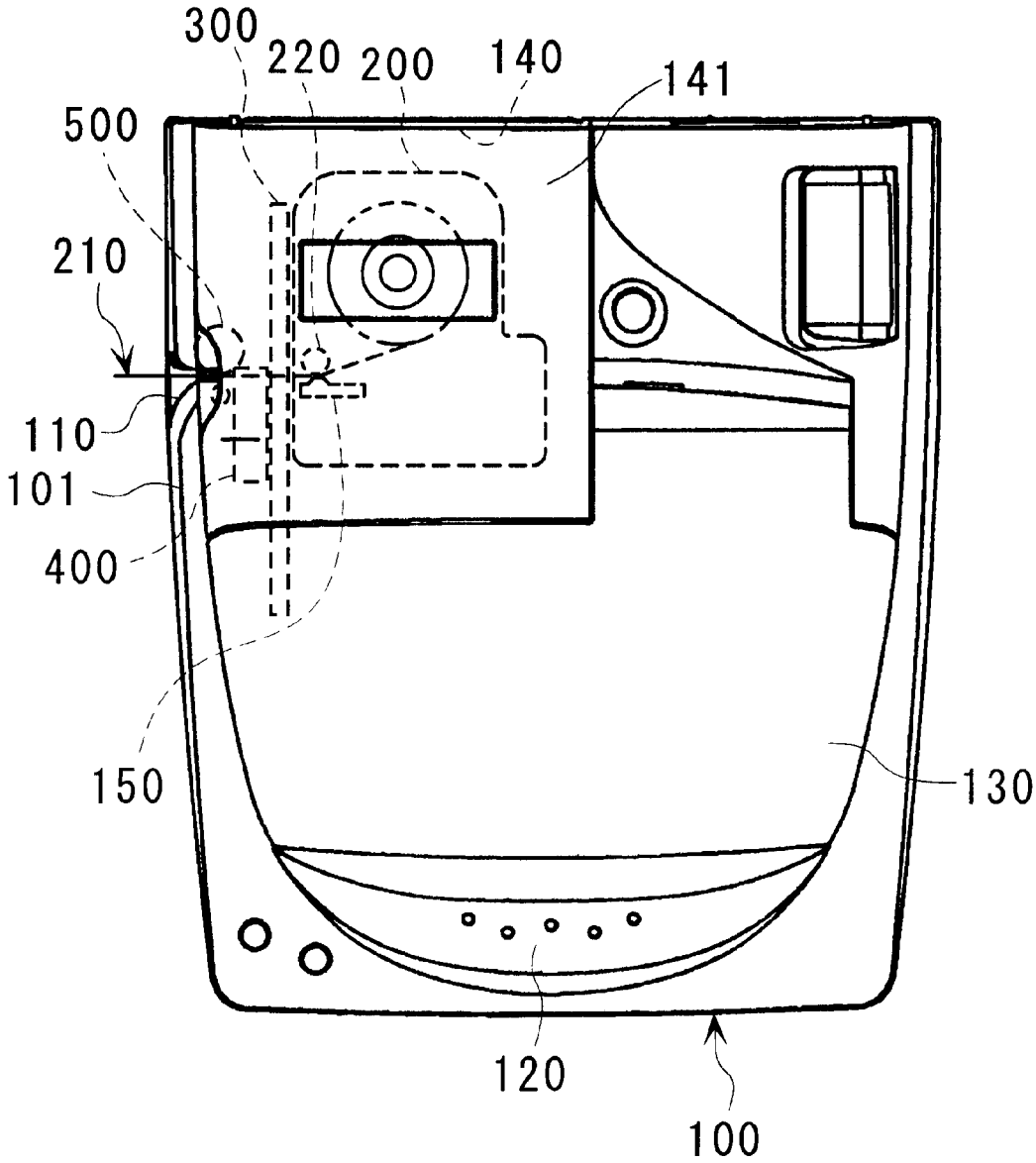
FIG. 1 is a diagram showing a top view of a tape printing apparatus according to an embodiment of the invention.
Figure 2:
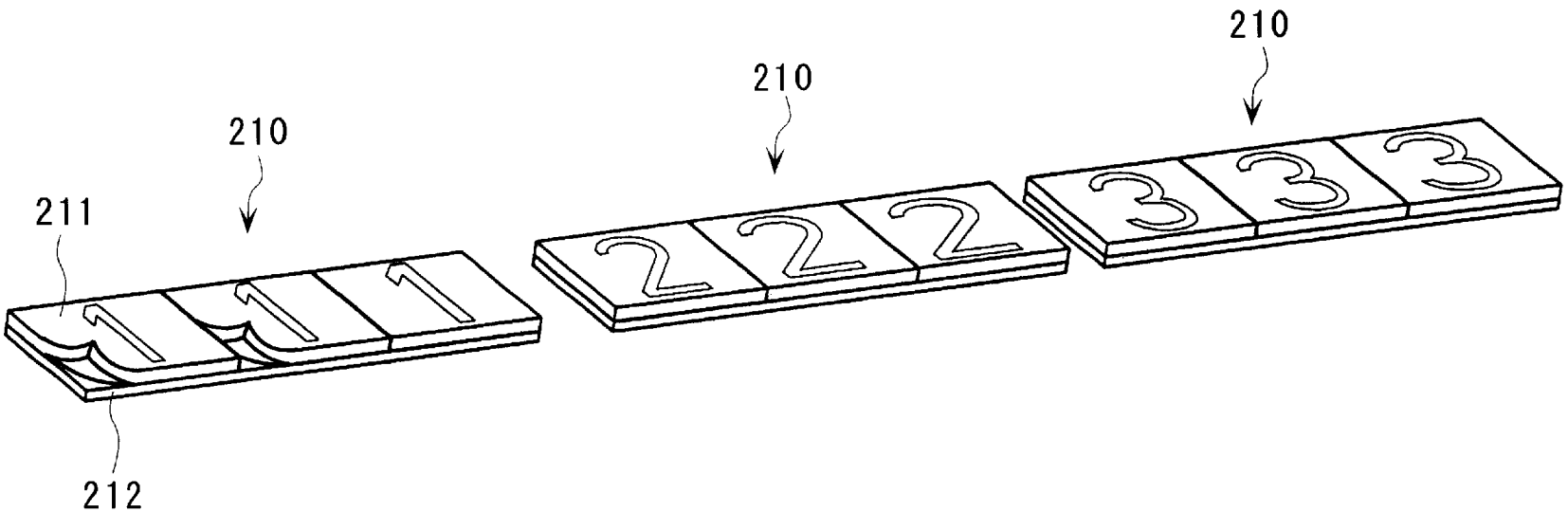
FIG. 2 is a perspective view of a tape material.

FIG. 1 is a diagram showing a top view of a body 100 of a tape printing apparatus according to the embodiment of the invention. The apparatus body 100 has a tape cartridge 200 removably mounted therein. Referring to FIG. 2, a tape material 210 which is formed of a laminate of a printing tape 211 and a peel-off paper 212 is accommodated within the tape cartridge 200 in the form of a roll. Further, the apparatus body 100 is provided with a tape feed means including a platen roller 220, for feeding the tape material 210, and a printing means including a print head 150, for printing on the printing tape 211 of the tape material 210 being fed or advanced.

Further, arranged at a location downstream of the printing means in the direction of feed of the tape material 210 is a full-cutting means 300 for cutting off a printed portion of the tape material 210. At a location downstream of the full-cutting means 300 in the direction of feed of the tape material 210, there is arranged a side enclosure 101 of the apparatus body 100. The side enclosure 101 is formed with a tape exit 110 through which a cut-off and separated strip of the tape material 210 is discharged from the apparatus 100. Further, between the tape exit 110 and the full-cutting means 300, there is arranged a half-cutting means 400 for cutting only one of the printing tape 211 and the peel-off paper 212, and between the half-cutting means 400 and the tape exit 110, there is arranged a tape discharge means 500 for forcibly discharging the cut-off and separated strip of the tape material 210 from the tape exit 110. It should be noted that in the present embodiment, description is given of a case in which only the printing tape 211 is cut by the half-cutting means 400.

Figure 3:
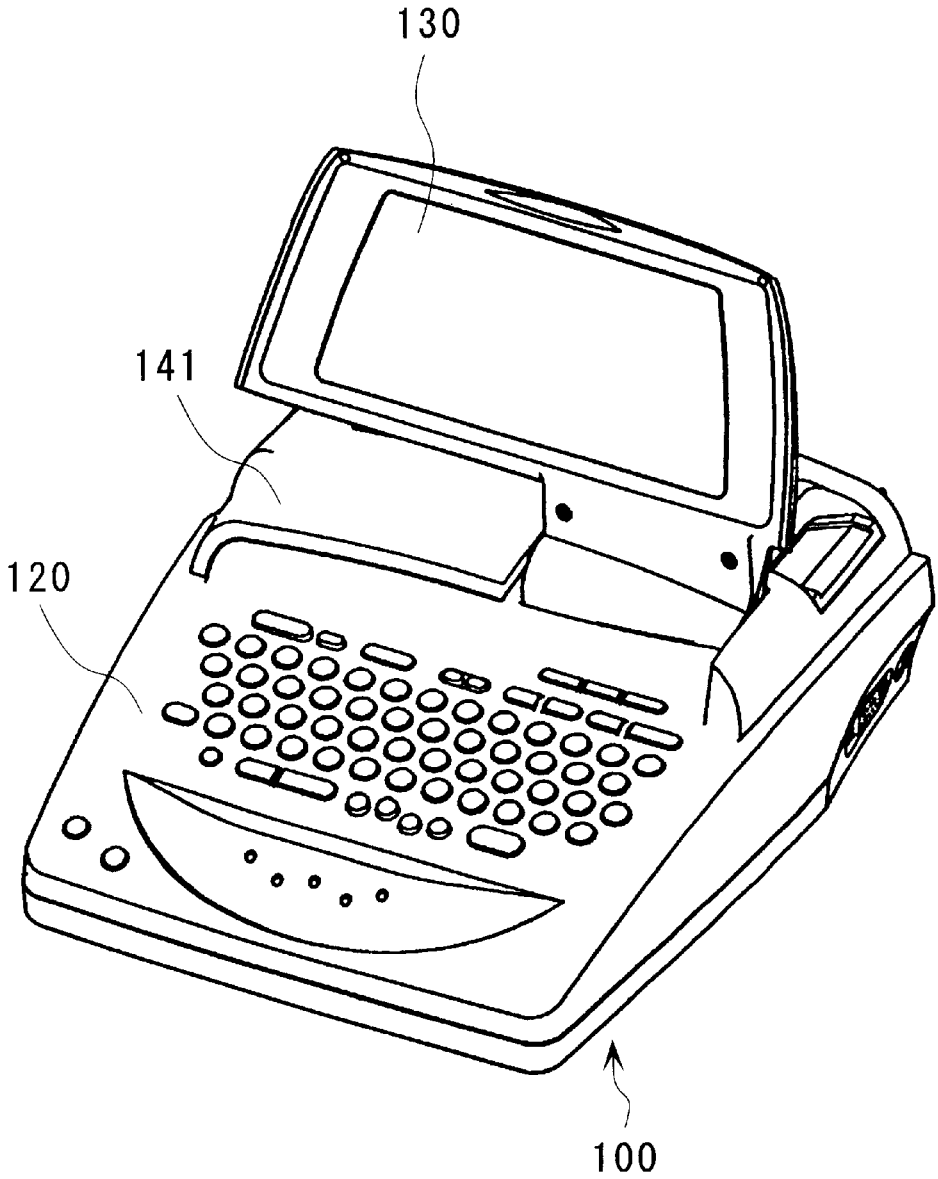
FIG. 3 is a perspective view of the tape printing apparatus according to the embodiment with a display thereof being open.

As shown in FIGS. 1 and 3, the apparatus body 100 has an operation panel 120 arranged on the top of the front portion thereof, which includes various kinds of entry keys, and a display 130 which also serves as a cover of the operation panel 120. Further, the apparatus body 100 has a box-like tape cartridge compartment 140 arranged in the rear portion thereof for removably receiving the tape cartridge 200 therein. The tape cartridge compartment 140 can be closed and opened by a cover 141. Further, a power supply unit, various kinds of indicator lamps, a trimmer unit, etc. are arranged within or on the apparatus body 100.

Figure 4:
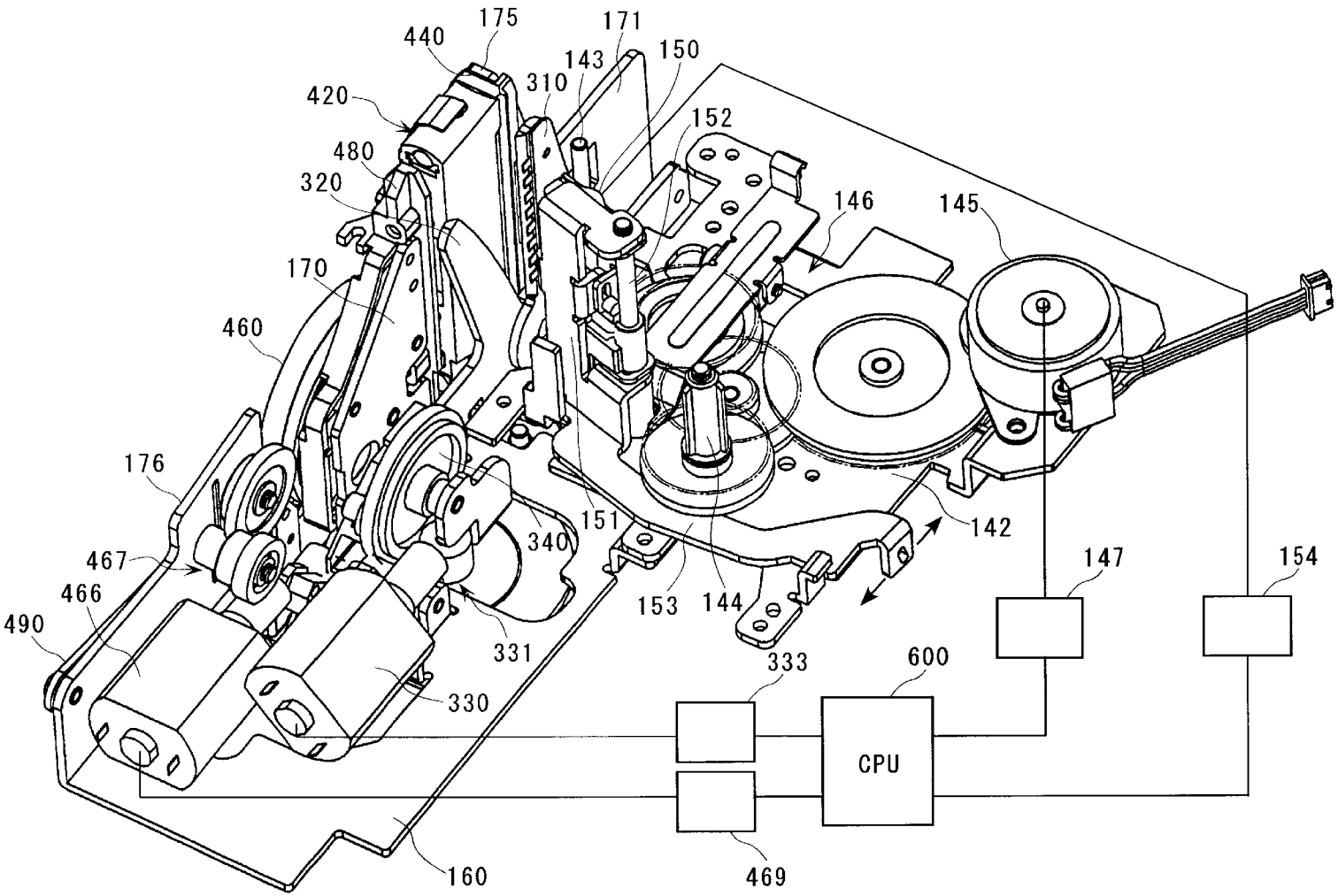
FIG. 4 is a perspective view schematically showing the main internal construction of the tape printing apparatus according to the embodiment of the invention.

Referring to FIG. 4, in the tape cartridge compartment 140, a platen roller rotational shaft 143 and an ink ribbon take-up shaft 144 are rotatably erected on a compartment frame 142 in the form of a plate such that torque of a drive motor 145 can be simultaneously transmitted to the platen roller rotational shaft 143 and the ink ribbon take-up shaft 144 via a gear train 146. The above devices are arranged such that they are covered by a bottom plate, not shown, of the tape cartridge compartment 140, and the platen roller rotational shaft 143, the ink ribbon take-up shaft 144, and a print head 150, referred to hereinafter, extend through the bottom plate such that they protrude into the tape cartridge compartment 140.

Further, in the tape cartridge compartment 140, the print head 150 formed of a thermal head or the like is held by a head holder 151 in a manner opposed to the platen roller rotational shaft 143. The head holder 151 can be pivotally moved about a head holder shaft 152, and has a release lever 153 extending from a lower end portion thereof at right angles to the same. The release lever 153 is operated in a manner interlocked with the opening/closing operation of the cover 141. The head holder 151 is caused to pivotally move about the head holder shaft 152 via the release lever 153, whereby the print head 150 can be moved toward or away from the platen roller 220 fitted on the platen roller rotational shaft 143.

Figure 5:
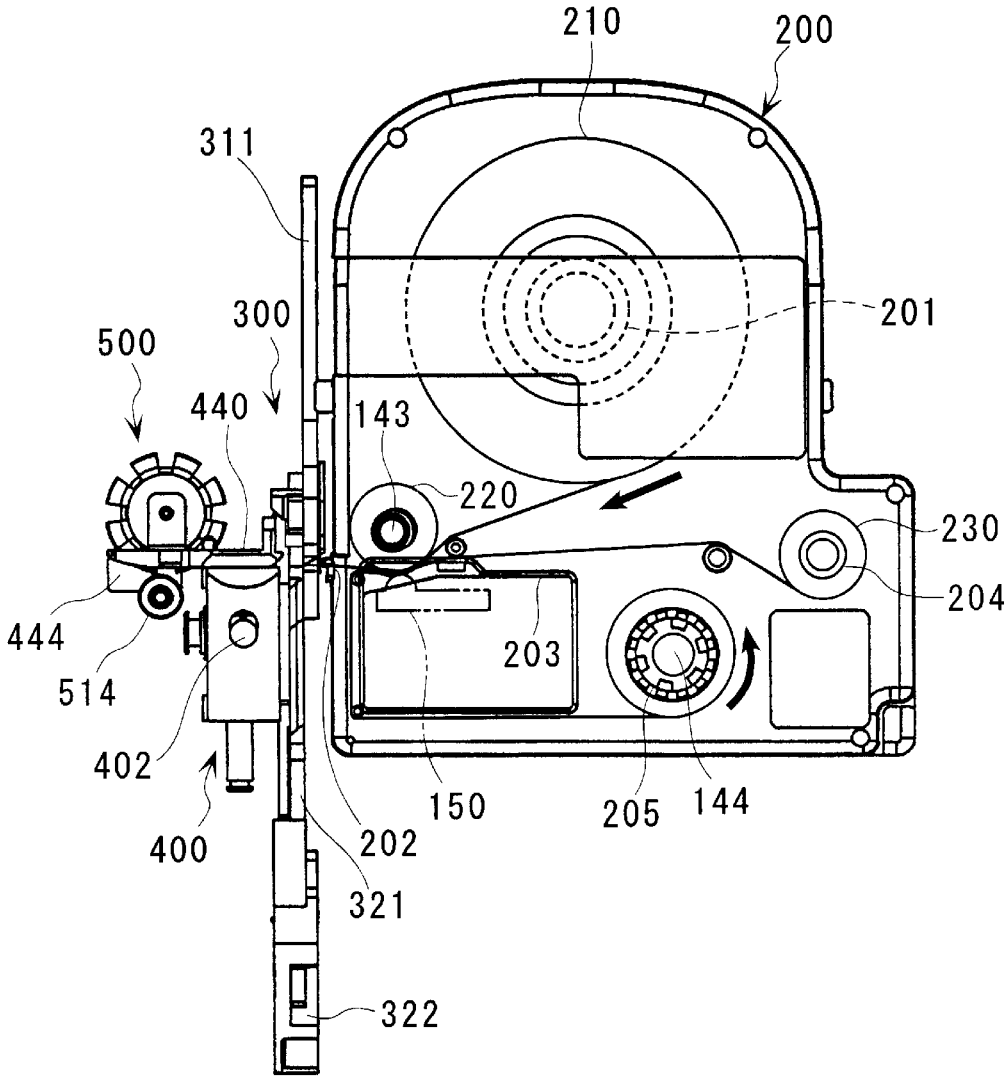
FIG. 5 is a diagram schematically showing a top view of a tape cartridge in a state mounted in the tape printing apparatus.

As shown in FIG. 5, the tape cartridge 200 has a tape supply spool 201 arranged therein for mounting a roll of the tape material 210. The leading edge of the tape material 210 is drawn out to a tape-sending slit 202 provided in a full-cutting means-side wall of the tape cartridge 200. Arranged in the vicinity of the tape-sending slit 202 is the platen roller 220 which can be rotated by the platen roller rotational shaft 143 engaged therewith, and an opening 203 which the print head 150 faces via the tape material 210 is provided at a location opposed to the platen roller 220. Further, within the tape cartridge 200 there are arranged a ribbon supply spool 204 for feeding an ink ribbon 230 between the platen roller 220 and the print head 150, and a ribbon take-up spool 205 which can be rotated by the ink ribbon take-up shaft 144 engaged therewith.

When the tape cartridge 200 is mounted in the tape cartridge compartment 140, the platen roller rotational shaft 143 and the platen roller 220 are engaged with each other, and the ink ribbon take-up shaft 144 and the ribbon take-up spool 205 are engaged with each other. Further, the print head 150 facing toward the opening 203 is urged by the platen roller 220 in a manner interlocked with the closing operation of the cover 141. When printing is instructed, the drive motor 145 operates to drive the platen roller 220 and the ribbon take-up spool 205 for rotation, and the tape material 210 is printed by the print head 150 while being advanced, and sent out through the tape-sending slit 202 to the full-cutting means 300 (toward the tape exit 110).

As shown in FIGS. 4 and 6 to 8, the full-cutting means 300 is in the form of scissors extending upward whose fixed blade 310 and movable blade 320 are supported by a common support shaft 301, and is configured such that torque of a full-cutting drive motor 330 is converted to pivotal motion of the movable blade 320 by a gear train 331 and a rotary disk 340 for causing the movable blade 320 to perform cutting operations.

Figure 8:
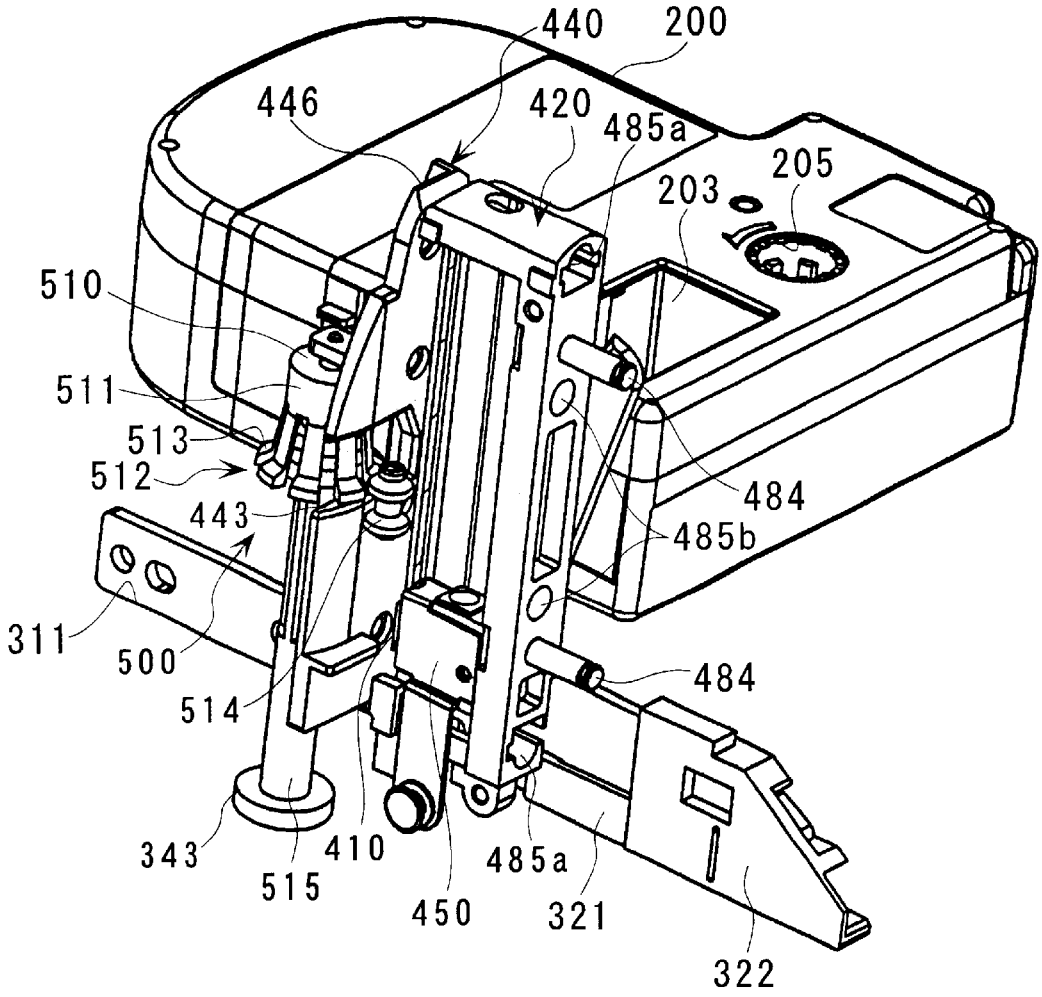
FIG. 8 is a perspective view showing the positional relationship between the tape discharge means, the half-cutting means, the full-cutting means and the tape cartridge.

The fixed blade 310 and the movable blade 320 have a fixed arm 311 and a pivotal arm 321 at respective lower ends thereof. The fixed arm 311 and the pivotal arm 321 extend substantially perpendicularly to the fixed blade 310 and the movable blade 320 in respective opposite directions. The fixed arm 311 is rigidly fixed to a reception plate frame portion 171, referred to hereinafter. The pivotal arm 321 has, as shown in FIG. 8, an arm holder 322 formed of a resin or the like attached to an end thereof. This arm holder 322 has a surface on a full-cutting drive motor side formed with an elongate groove, not shown, extending in the direction of the length of the pivotal arm 321.

Referring to FIG. 4, the full-cutting drive motor 330, the gear train 331 and the rotary disk 340 are arranged on a cutter-supporting frame 160 in the form of a plate. The torque of the full-cutting drive motor 330 is transmitted to the rotary disk 340 via the gear train 331 comprised of a worm gear 331*a* and a worm wheel 331*b*, thereby rotating the rotary disk 340 about a rotational shaft 341 parallel to the support shaft 301 of the fixed blade 310 and movable blade 320. The rotary disk 340 has a pivotal arm-side end face formed with a crank projection, not shown, fitted into the elongate groove of the pivotal arm 321. Therefore, torque of the rotary disk 340 is converted to pivotal motion (swinging motion) of the pivotal arm 321.

Figure 6:
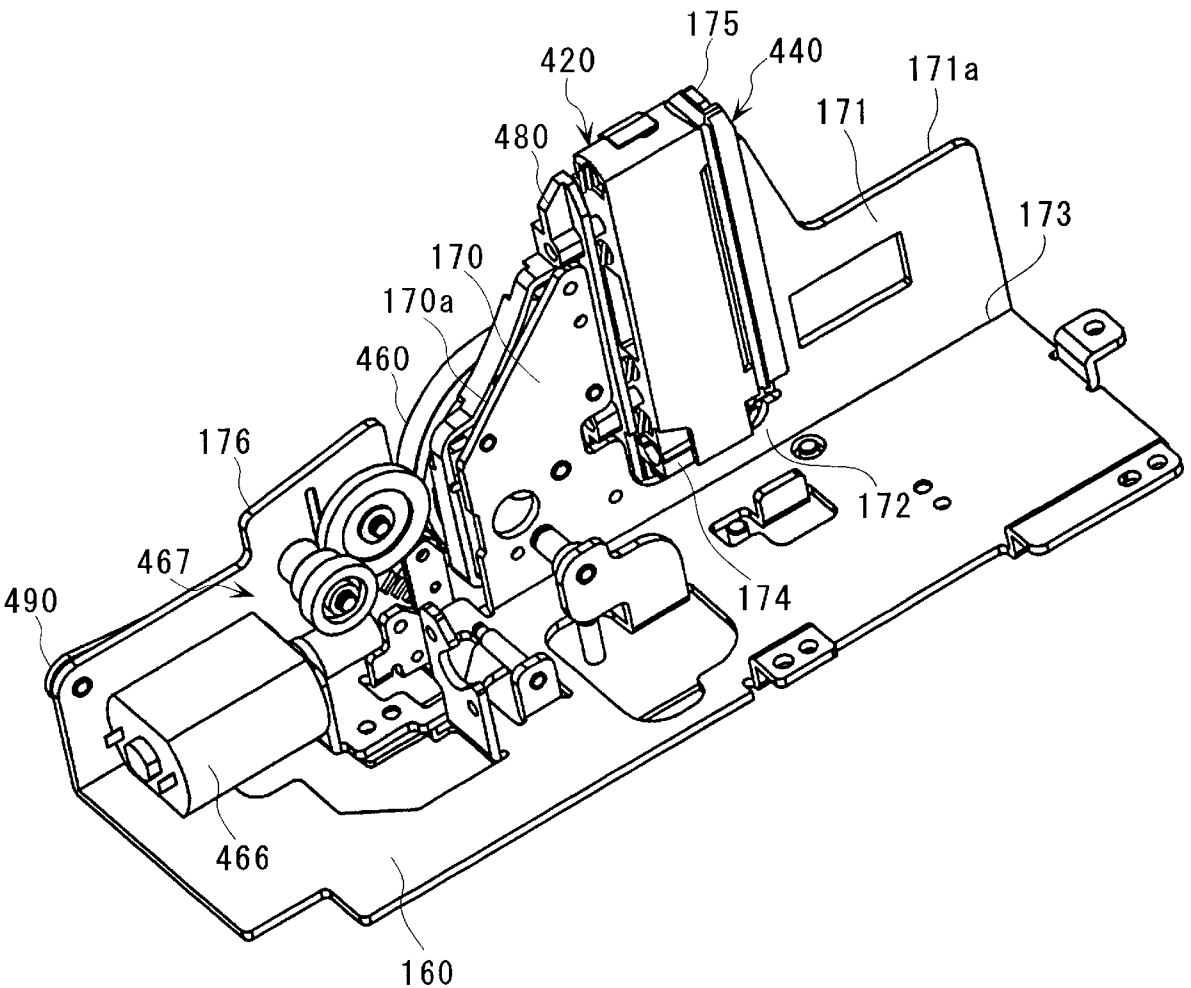
FIG. 6 is a perspective view of a mounting frame of a half-cutting means.
Figure 9:
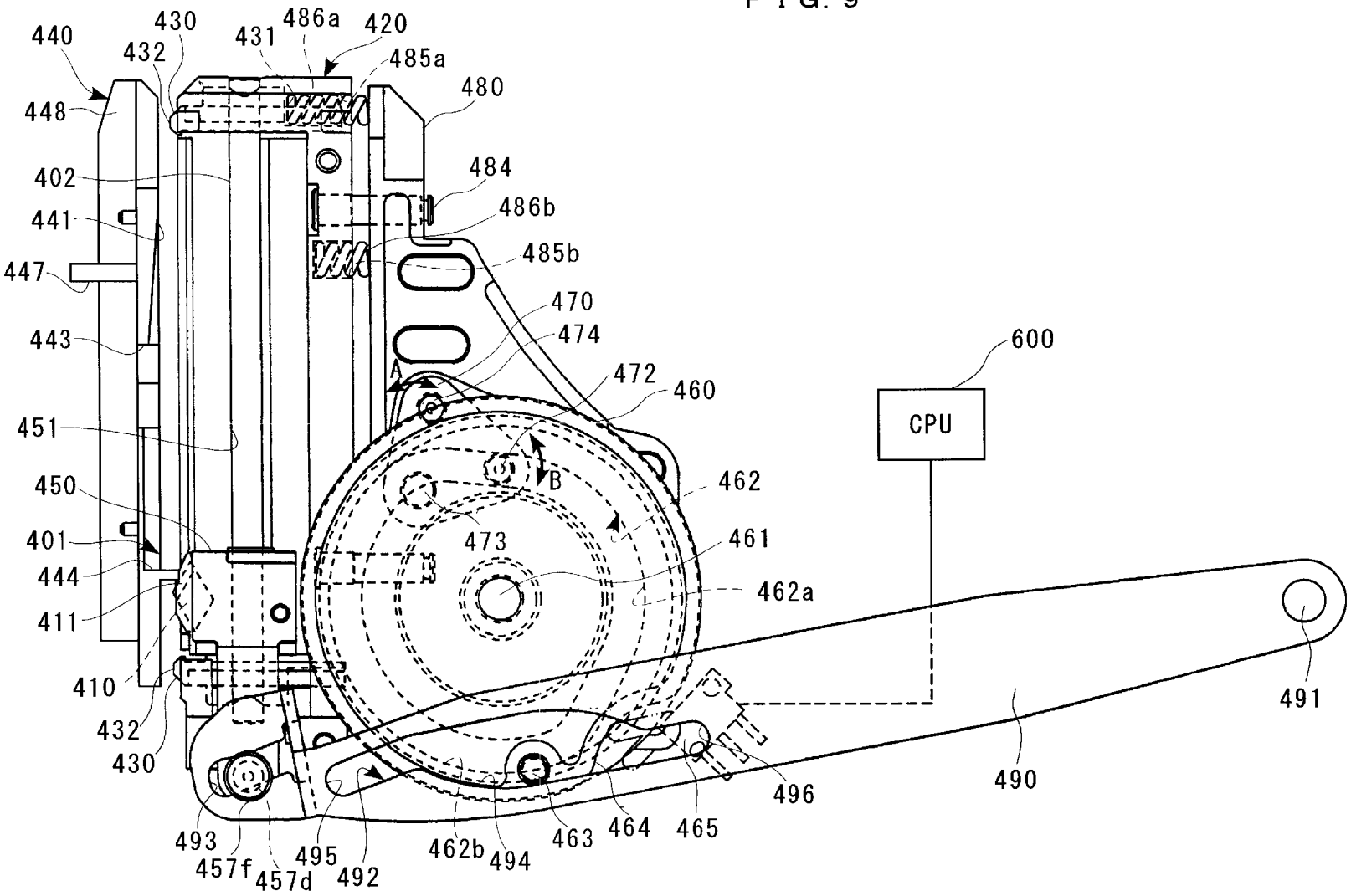
FIG. 9 is a diagram useful in explaining the construction of a cutter actuation mechanism of the half-cutting means.

As shown in FIGS. 6, 8 and 9, the half-cutting means 400 is arranged on a cutter frame portion 170 and the reception plate frame portion 171 extending upward from the cutter-supporting frame 160. The outer surface of the cutter frame portion 170 is used as an attachment reference face 170*a* to which are attached a half cutter 401 comprised of an angular cutter blade 410 and a cutter holder 450 for holding the angular cutter blade 410, a tape-retaining member 420, a pair of blade-positioning members 430, and a cutter-actuating mechanism for actuating the above component parts.

On the other hand, an outer surface of the reception plate frame portion 171 on the same side as that of the attachment reference face 170*a* is used as an attachment reference face 171*a* with reference to which is arranged a tape reception plate 440 which is opposed to the half cutter 401 via the tape material 210 for receiving the tape material 210. A half-cutting mechanism is formed by the tape reception plate 440 and the half cutter 401. Further, an in-plane direction in the cutter frame portion 170 and the reception plate frame portion 171 is identical to a direction of cutting of the cutter blade 410.

The tape material 210 is inserted between the tape reception plate 440 and the half cutter 401 from an upper clearance therebetween to be removably mounted in the apparatus body 100. The cutter blade 410 is arranged such that it can be slid upward from below for cutting operation and at the same time moved toward or away from the tape reception plate 440 by the cutter-actuating mechanism. Similarly, the tape-retaining member 420 and the pair of blade-positioning members 430 are arranged such that they can be moved toward or away from the tape reception plate 440.

The cutter frame portion 170 and the reception plate frame portion 171 as well as a connecting frame portion 172 connecting base portions thereof are formed from part of the cutter-supporting frame 160 by bending the same along the same bending line 173 in the same direction at the same angle into a general L-shaped cross-sectional configuration. The tape material 210 is brought into a space 174 between the mounting frames 170 and 171 such that it is inserted between the cutter blade 410 and the tape reception plate 440. Thus, the cutter frame portion 170 and the reception plate frame portion 171 are integrally formed as a unitary member by bending the part of the cutter-supporting frame 160, and hence they are located in the same plane. This contributes to enhanced accuracy in position of the associated members arranged on the cutter blade side and the tape reception plate side, thereby enhancing the cutting accuracy of the cutter blade 410.

Figure 13:
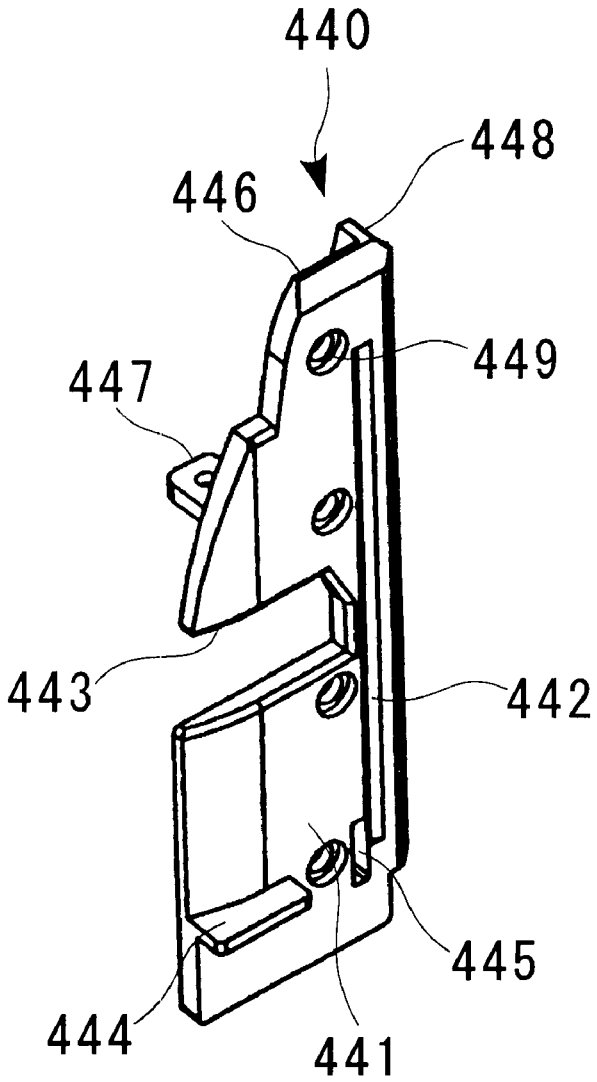
FIG. 13 a perspective view of a tape reception plate.

Referring to FIG. 13, the tape reception plate 440 has a reception groove 442 which is formed in a tape reception surface 441 opposed to the cutter blade 410, along a cutting line in a direction of upward/downward sliding of the cutter blade 410. The cutter blade 410 is fitted into this reception groove 442 for cutting operation. As described above, by providing the reception groove 442, elasticity of the tape material 210 can be utilized when the cutter blade 410 is performing a cutting operation, whereby it is possible to maintain the stable cutting accuracy of the cutter blade 410 even if the position of the cutting edge 411 of the cutter blade 410 varies.

It should be noted that the reception groove 442 is formed to be longer in a vertical direction than the width of the tape material 210 to be printed. Further, a cut-away portion 443 is formed at a location downstream of the reception groove 442 in the direction of feed of the tape material 210 and adjacent to the intermediate portion of the groove 442. This cut-away portion 443 is provided so as to bring the discharge roller 510 of the tape discharge means 500 to a tape reception surface side. Further, arranged under the cut-away portion 443 is a tape feed guide 444 protruding in the form of a shelf.

Still further, an escape hole 445 is arranged at a location downstream of the reception groove 442 in the direction of feed of the tape material 210 and adjacent to the lower end portion of the groove 442. This escape hole 445 is provided for allowing the cutter blade protection block 403*e* of a cutter cover, referred to hereinafter, to be fitted therein. It should be noted that the escape hole 445 extends below the lower end of the fed tape material 210 in the direction of the width thereof. Further, a support flange 447 for supporting an upper end portion of a discharge roller 510, referred to hereinafter, protrudes from a back surface 446 of the tape reception plate 440 at a location above the cut-away portion 443.

Further, the tape reception plate 440 has a bent portion 448 formed at right angles to an edge on a reception groove-side thereof, and the back surface 446 is formed as a surface bent into two portions at right angles to each other. On the other hand, as shown in FIG. 6, the reception plate frame portion 171 has a mounting flange 175 formed at right angles to an edge on a space side of the portion 171 such that the flange 175 extends outwardly. If the right-angled back surface 446 of the tape reception plate 440 is fitted in the right-angled corner of the mounting flange 175, perpendicularity of the tape reception surface 441 and the reception plate frame portion 171, and verticality of the tape reception plate 440 can be provided with accuracy. The tape reception plate 440 is fixed to the mounting flange 175 e.g. by screwing the tape reception plate 440 thereto via screw holes 449 formed in the tape reception plate 440. Further, a portion corresponding to the cut-away portion 443 of the tape reception plate 440 is cut away in advance from the mounting flange 175.

Figure 14:
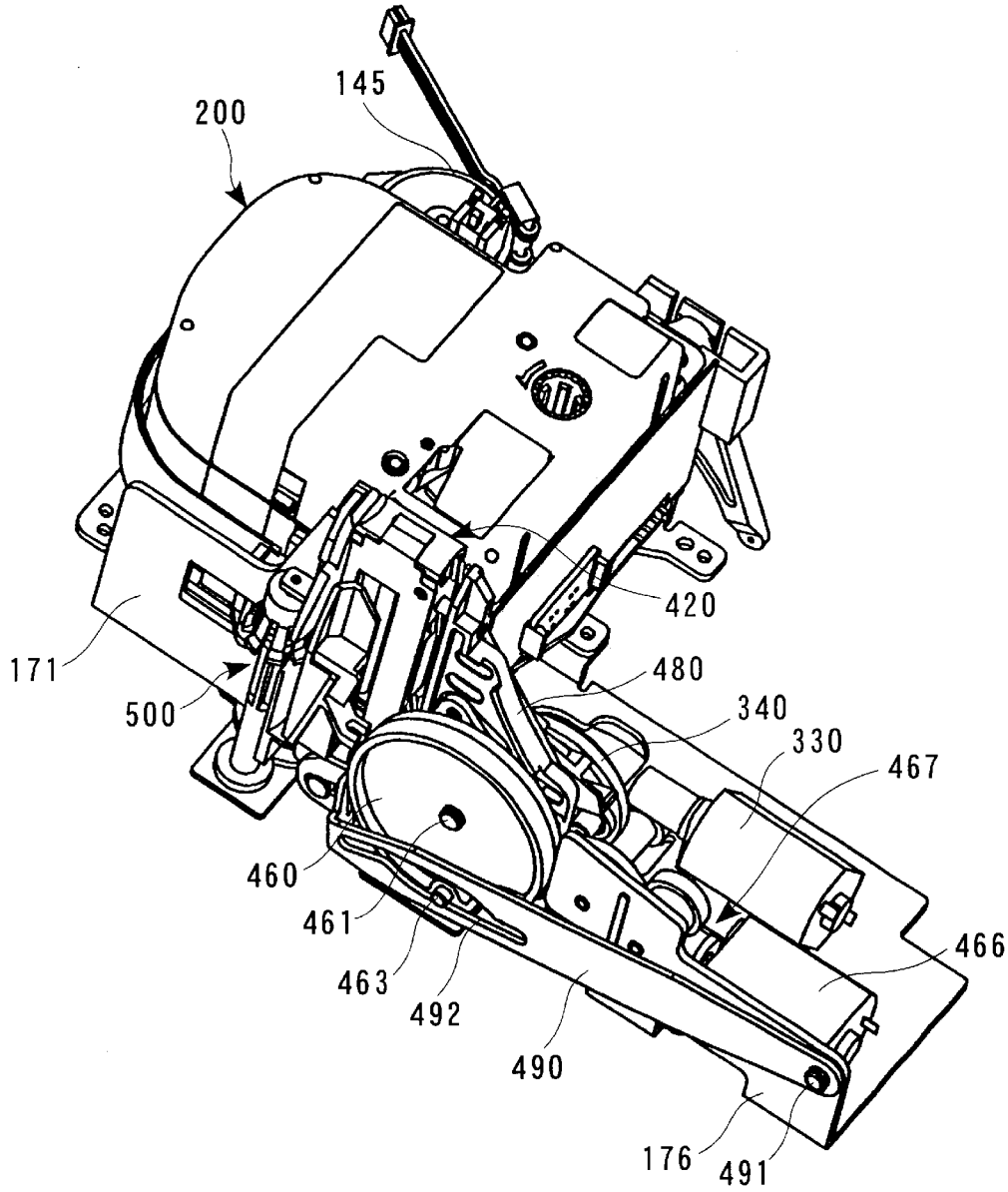
FIG. 14 is a perspective view showing the positional relationship between the tape discharge means, the half-cutting means, the full-cutting means, the cutter actuation mechanism, and the tape cartridge.

Referring to FIGS. 6, 9 and 14, on the cutter blade side, there are arranged the tape-retaining member 420 opposed to the tape reception plate 440, a guide shaft 402 vertically held by the tape-retaining member 420, the half cutter 401 including the cutter holder 450 and the cutter blade 410 slidably mounted on the guide shaft 402, the pair of blade-positioning members 430 at the upper and lower end portions of the guide shaft 402, and the cutter-actuating mechanism for actuating the above component parts.

The cutter-actuating mechanism is comprised of a rotary disk 460 performing rotational motion, an input plate 470 for converting the rotational motion of the rotary disk 460 to pivotal motion (swinging motion), a support block 480 for converting the pivotal motion (swinging motion) of the input plate 470 to reciprocating linear motion, and an input arm 490 for converting the rotational motion of the rotary disk 460 to pivotal motion. The support block 480 is connected to the tape-retaining member 420 such that it can transmit the reciprocating linear motion thereof to the tape-retaining member 420, and hence the tape-retaining member 420 can be moved toward or away from the tape reception plate 440. Further, the input arm 490 is connected to the cutter holder 450 such that it can transmit the pivotal motion thereof to the cutter holder 450, and hence the cutter holder 450 can slide for cutting operation.

Figure 15:
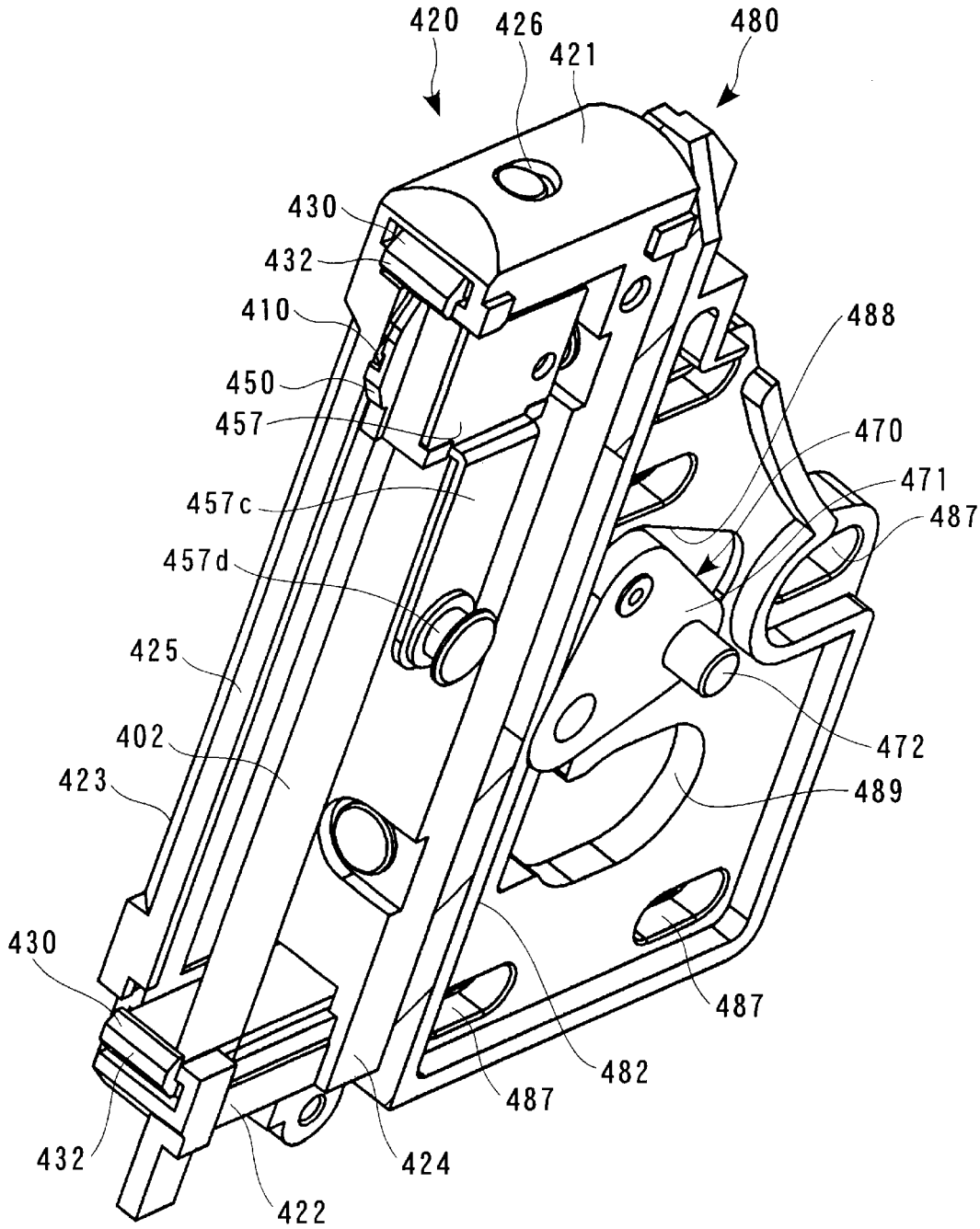
FIG. 15 is a perspective view showing the positional relationship between a tape-retaining member, a positioning member, a guide shaft, and a cutter holder.
Figure 16:
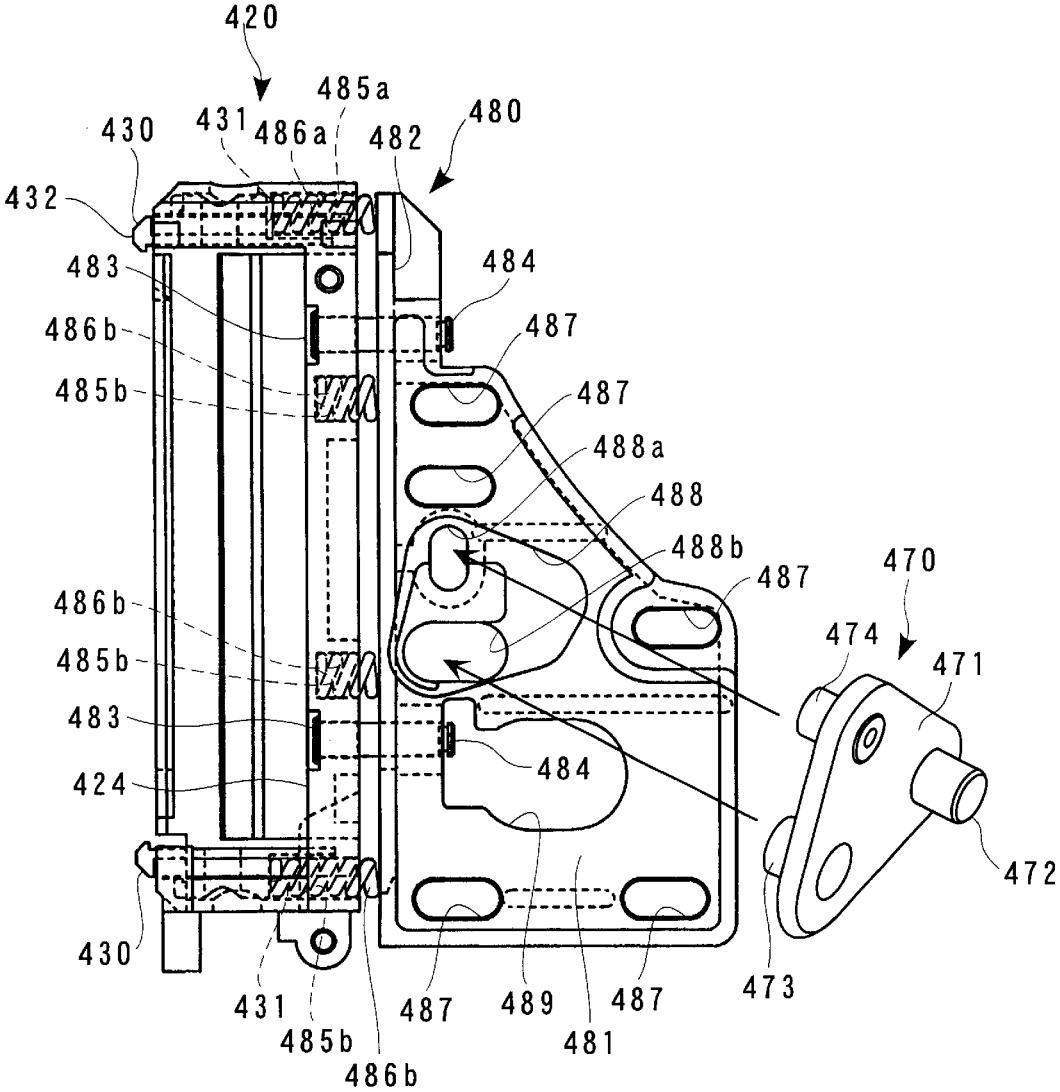
FIG. 16 is a perspective view showing the positional relationship between the tape-retaining member, the positioning member, a support block, and a pivotal member.
Figure 17:
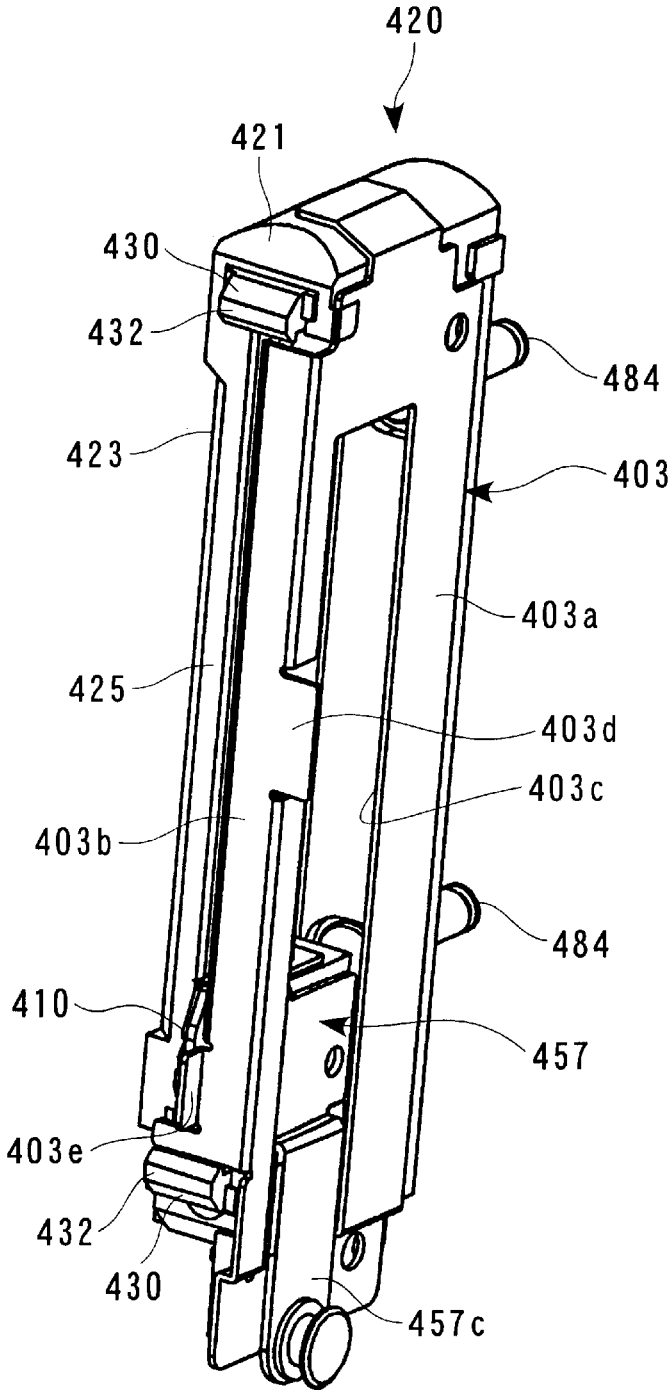
FIG. 17 is a diagram useful in explaining the construction of a cutter cover.

As shown in FIGS. 15 to 17, the tape-retaining member 420 includes a top plate 421 and a bottom plate 422 arranged in a manner opposed to each other in the vertical direction as well as two adjacent side plates 423 and 424 connecting the top and bottom plates.

An end surface of the side plate 423, which is opposed to the tape reception plate 440, is formed with a tape-retaining face 425 extending in the vertical direction, whereby it is possible to push the tape material 210 against the tape reception surface 441 of the tape reception plate 440 to fix the tape material 210. This makes it possible to prevent the displacement of the tape material 210 during cutting operation, and further prevent the displacement of a cut-off strip of the printed tape material 210. On the other hand, the side plate 424 is connected to the support block 480, which will be described hereinafter.

Figure 18:
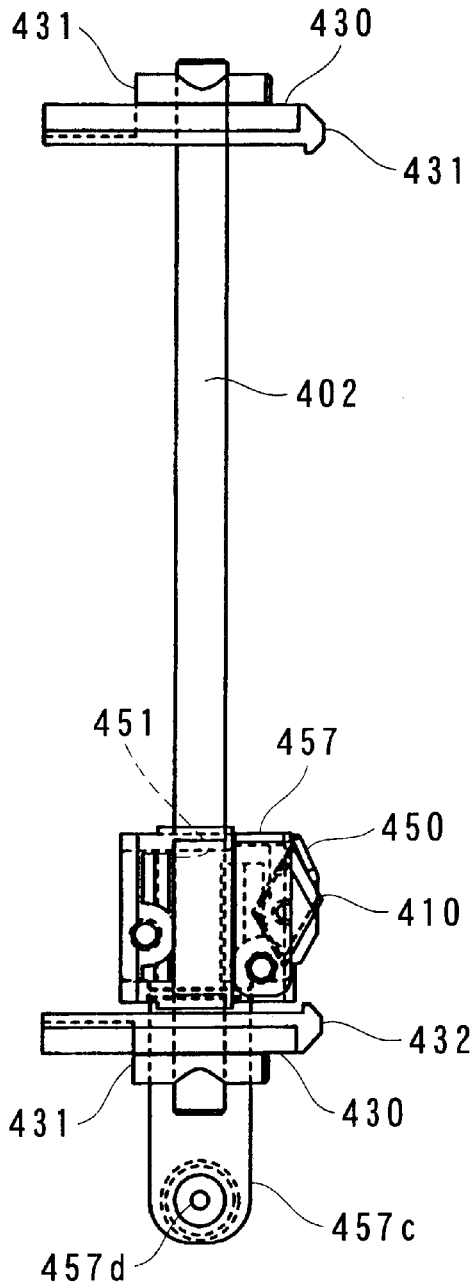
FIG. 18 is a diagram useful in explaining the construction of the positioning member.
Figure 19:
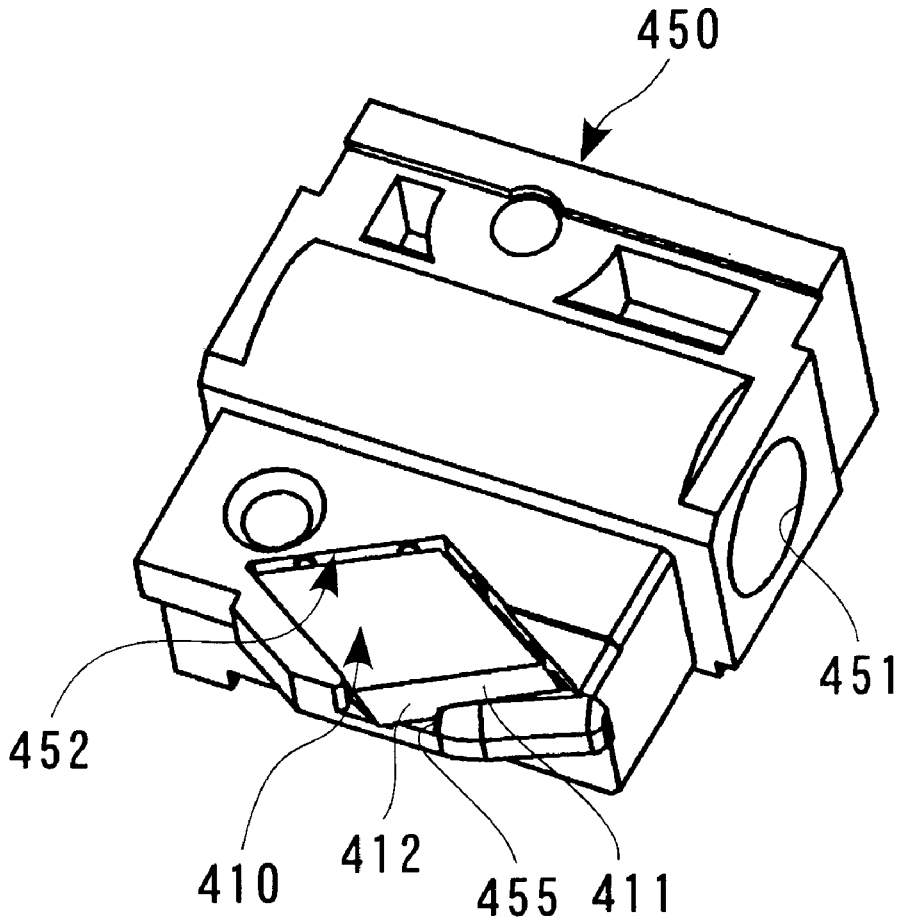
FIG. 19 is a diagram useful in explaining the construction of the cutter holder.
Figure 20:
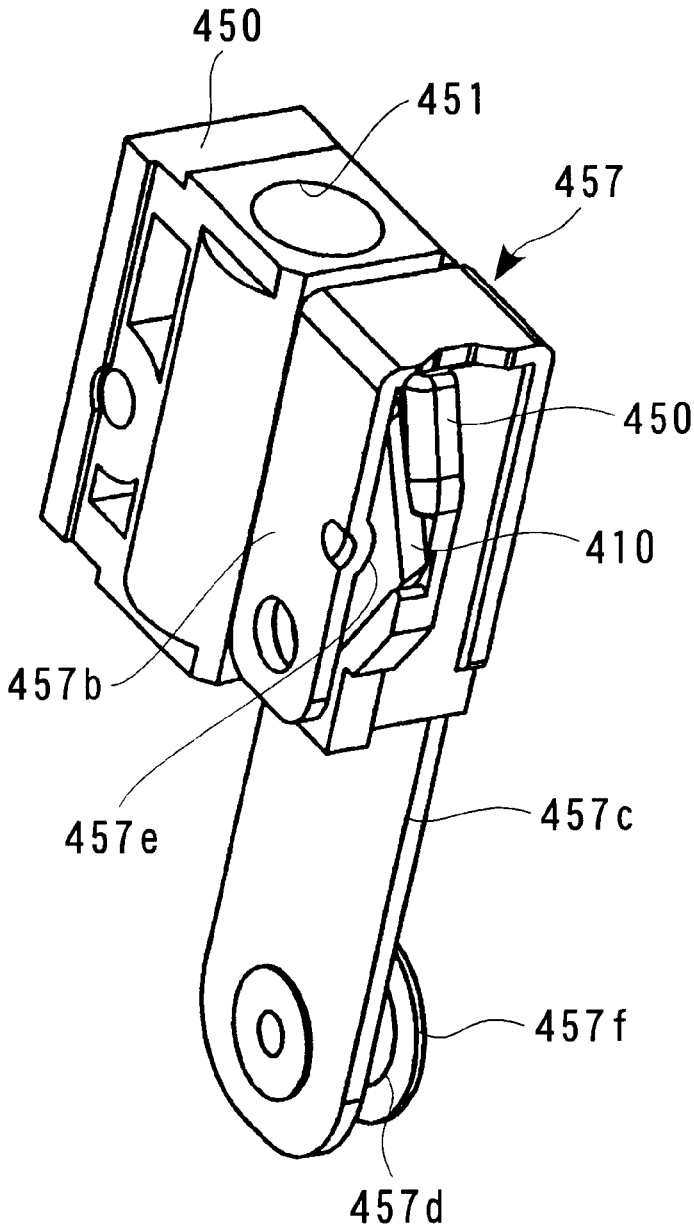
FIG. 20 is a diagram useful in explaining the construction of the cutter holder.
Figure 21:
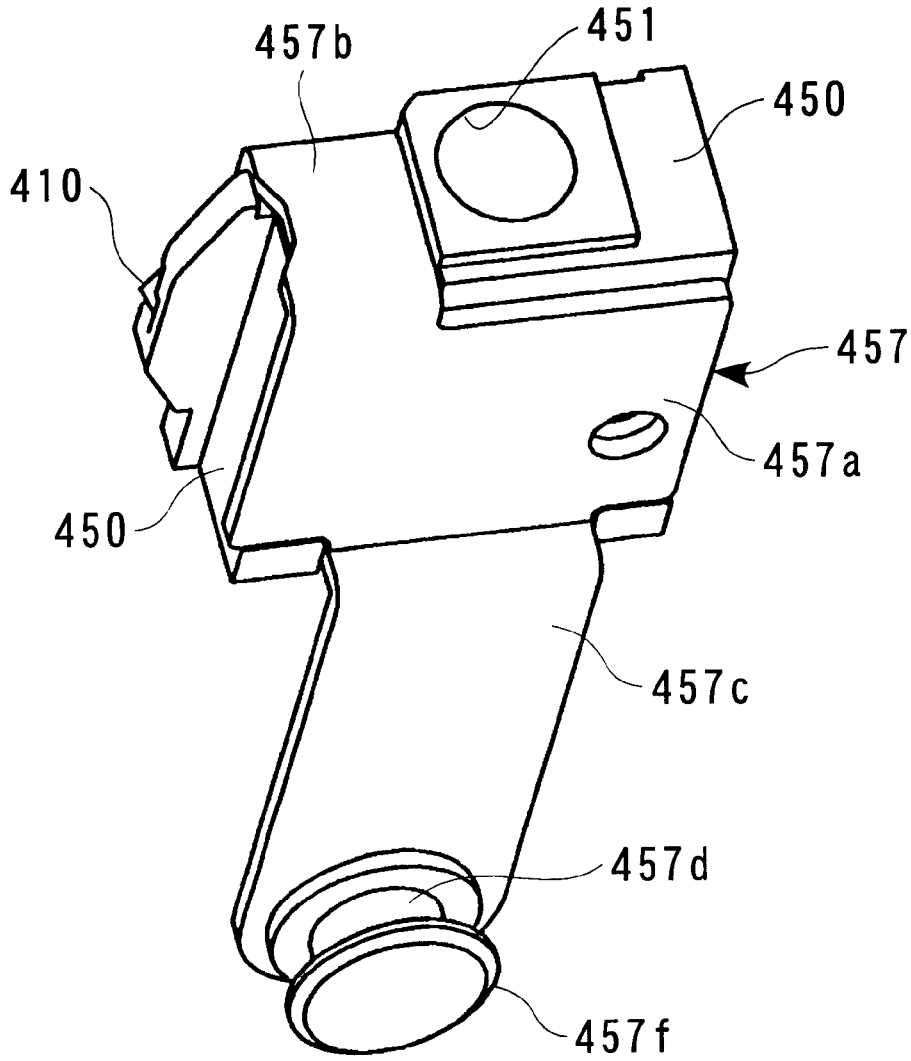
FIG. 21 is a diagram useful in explaining the construction of the cutter holder.

As shown in FIG. 15, the top plate 421 and the bottom plate 422 of the tape-retaining member 420 are formed with slots 426 (only a slot in the top plate 421 is shown in the figure) which extend from a side plate 424 side toward a tape-retaining face 425 side. The upper and lower end portions of the guide shaft 402 are slidably fitted into the slots 426, and as shown in FIG. 9, the guide shaft 402 is arranged in parallel with the tape reception plate 440. As shown in FIGS. 9, 15 and 18 (FIG. 18 is a diagram showing part of FIG. 9 as viewed from the side of the back surface), the pair of blade-positioning members 430 are rigidly fixed to upper and lower end portions inside the top plate 421 and the bottom plate 422 of the guide shaft 402, respectively.

These blade-positioning members 430 are formed of pieces of plate which can be accommodated in the tape-retaining member 420, and be moved toward or away from the tape reception plate 440 in unison with the guide shaft 402. Further, the other end surface of each of the blade-positioning members 430 remote from one end surface thereof opposed to the tape reception plate 440 is formed with a spring reception surface 431 for being brought into abutment with one end of a spring 486*a*, referred to hereinafter. Each blade-positioning member 430 is urged toward the tape reception plate 440 by the spring 486*a* such that it can elastically abut on the tape reception plate 440, and projects by a predetermined amount from the tape-retaining member 420. The ends of these projections form contact portions 432 for being brought into contact with the tape reception surface 441 of the tape reception plate 440.

Referring to FIGS. 19 to 23, the cutter blade 410 is held in the cutter holder 450. The cutter holder 450 is formed with a through hole 451 for receiving therein the guide shaft 402, as shown in FIG. 9. This enables the cutter holder 450 to vertically slide between the pair of blade-positioning members 430 along the guide shaft 402, and the cutter blade 410 held in the cutter holder 450 can perform linear motion in the direction of the width of the tape material 210, that is, in a direction orthogonal to the direction of extension of the tape material 210 to cut off the tape material 210. It should be noted that the cutter holder 450 is designed such that it can slide beyond the upper and lower edges of the tape material 210 in the direction of the width thereof.

The cutter blade 410 is an angular blade in the form of a thin plate having a generally rectangular shape, and held in a cutter-holding portion 452 as a recess formed in a side surface of the cutter holder 450 fitted on the guide shaft 402, such that the cutter blade 410 protrudes toward the tape reception plate 440. The recess forming the cutter-holding portion 452 has a shape generally complementary to the cutter blade 410 exclusive of a portion defining a blade point (cutting point) 412. The cutter blade 410 according to the present embodiment has the shape of a rhombus which has one pair of sides adjacent to each other, including one corresponding to the cutting edge 411, that is, ones corresponding to the cutting edge 411 and a restriction edge 413 with the blade point 412 therebetween, and the other pair of sides corresponding to edges 414 and 415. Accordingly, the recess of the cutter-holding portion 452 also has the shape of a rhombus. Further, the cutter-holding portion 452 is defined by a bottom surface 453 in surface contact with one surface of the cutter blade 410, and side wall surfaces 454 surrounding the peripheral portions of the cutter blade 410. One of the side wall surfaces 454 has a corner formed with a cut-away portion 455 for allowing the blade point 412 to protrude from the cutter holder 450.

The side wall surfaces 454 arranged on opposite sides of the cut-away portion 455 provide blade-positioning portions 454*a* and 454*b*, respectively, with which the cutting edge 411 and restriction edge 413 of the cutter blade 410 are brought into abutment to define the amount of projection of the blade point 412 from the cut-away portion 455. As described above, since the cutting edge 411 and restriction edge 413 are brought into direct and intimate contact with the blade-positioning portions 454*b* and 454*a*, respectively, it is possible to make constant the amount of projection of the cutter blade 410 from the cutter holder 450, irrespective of variations in outer shapes of the cutter blade 410.

Further, the other two side wall surfaces 454 have a required number of protruding portions 456 protruding into the space of the cutter-holding portion 452. The cutter blade 410 is press-fitted in the cutter-holding portion 452 in a state in which the end portions of the protruding portions 456 are crushed by the edges 414 and 415, and fixedly held by the protruding portions 456 and the blade-positioning portions 454*a* and 454*b*. It should be noted that escape grooves 456*a* are formed in advance around the protruding portions 456 to allow the crushed materials of the end portions of the protruding portions 456 to escape therein.

Figure 22:
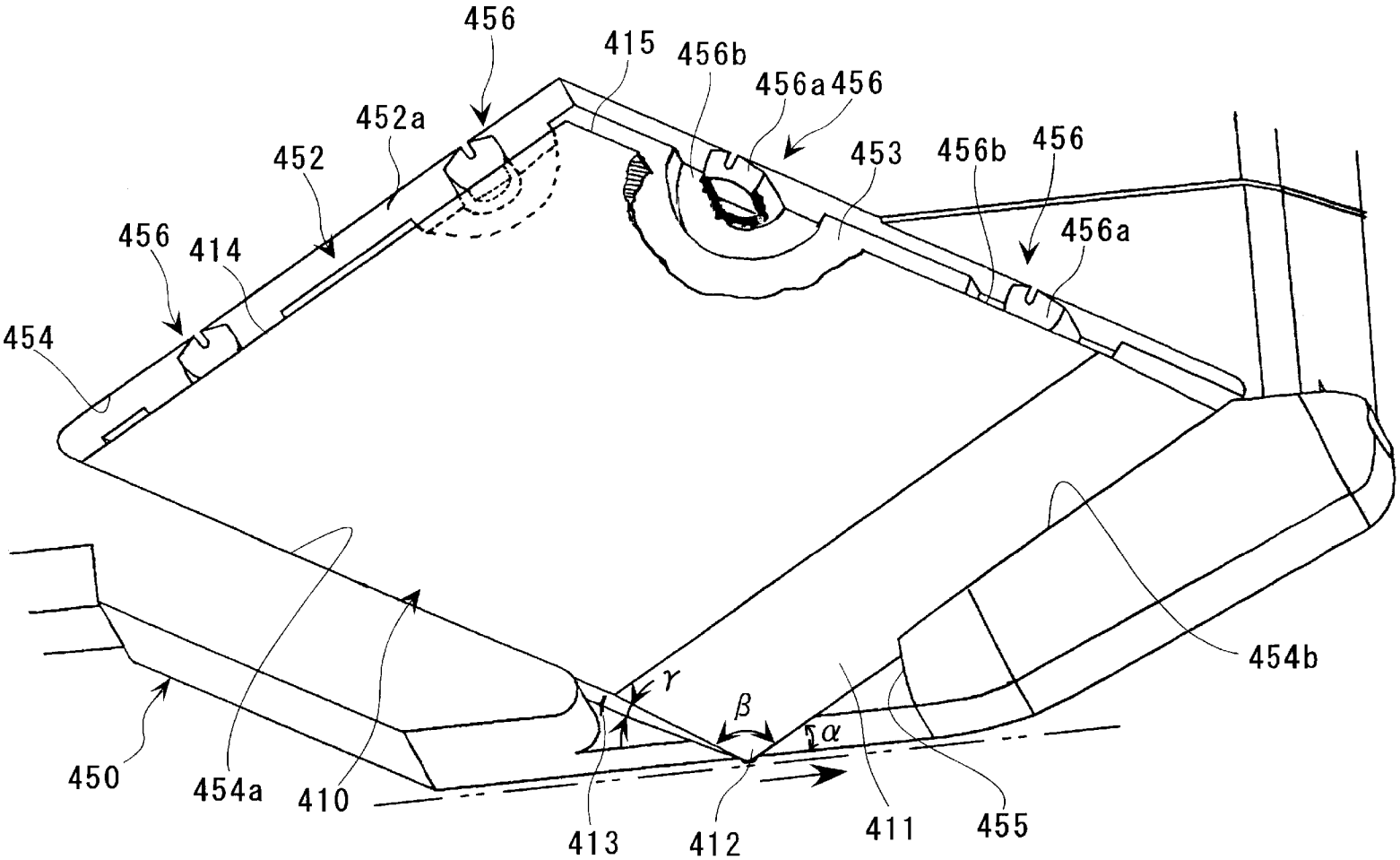
FIG. 22 is a diagram useful in explaining the arrangement of the cutter holder and a cutter blade.
Figure 23:
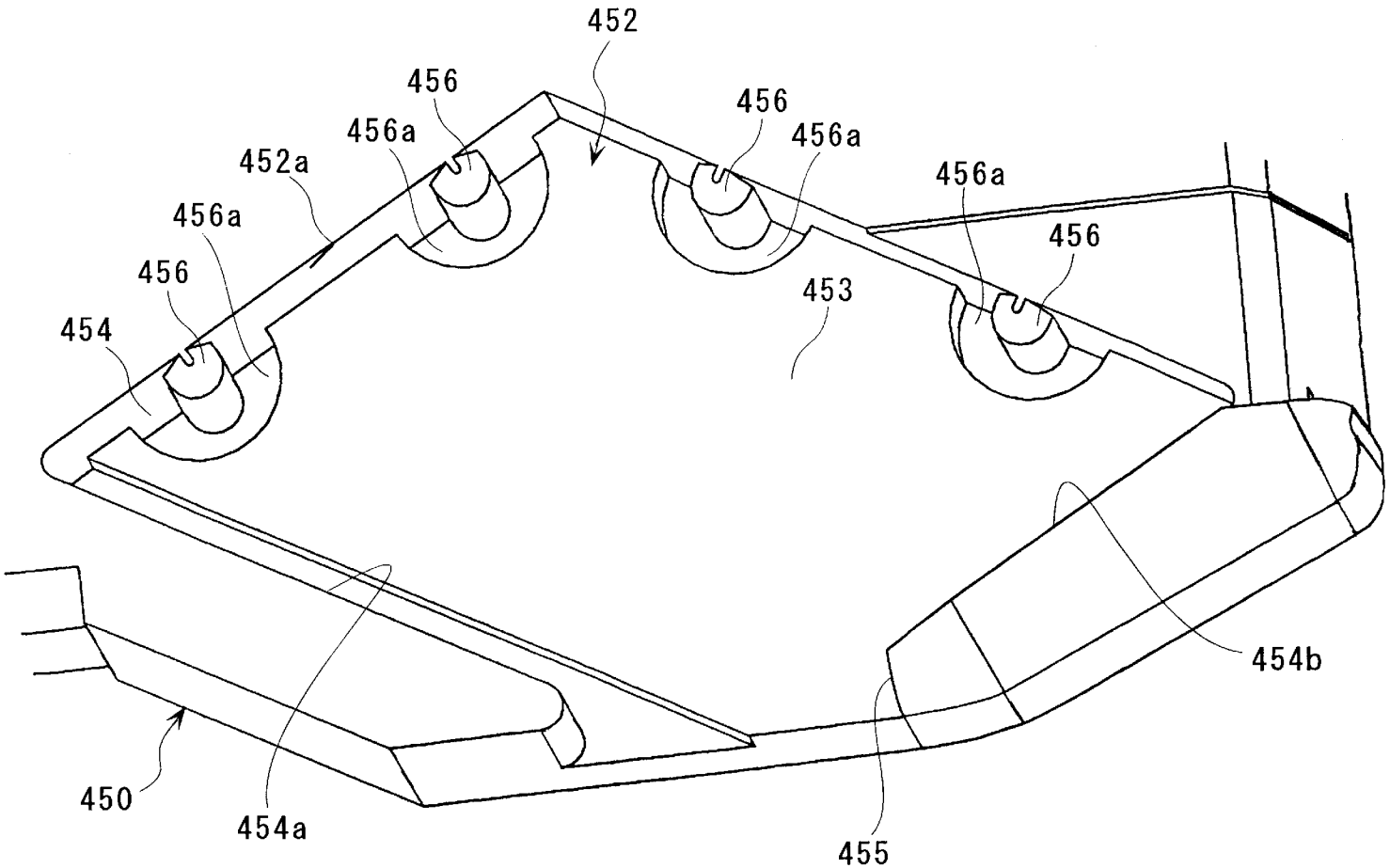
FIG. 23 is a diagram useful in explaining the construction of the cutter holder.

When the cutter blade 410 cuts across the full width of the tape material 210, the cutter blade 410 is brought into abutment with the edge of the tape material 210 in the direction of the width thereof, and suffers a significant damage. Further, the cutter blade 410 repeatedly performs intermittent cutting. This can cause the breakage and abrasion of the edge portion of the cutter blade 410. However, this problem can be solved by setting, as shown in FIG. 22, the entering angle α, blade point angle β, and cutting edge angle γ of the cutter blade 410 as follows:

In the cutter blade 410 held by the cutter holder 450, the entering angle α of the cutting edge 411 in the direction of slide-cutting operation of the tape material 210 (direction indicated by an arrow in the figure) should be set to a value within a range of 20 degrees to 60 degrees. This is because if the entering angle α is smaller than 20 degrees, cutting resistance becomes too large, while if the same is larger than 60 degrees, a deviated cut can be caused.

Further, the cutter blade 410 should have the blade point angle β set to 90 degrees or more (obtuse angle) Although if the blade point angle β is smaller than 90 degrees, the blade point 412 is liable to be broken when it is being worked or employed in cutting operation, the blade point angle β larger than 90 degrees makes it possible to prevent the breakage of the blade point 412 even if the tape material 210 is forcibly drawn out, to secure a sharp blade point as well as reduce abrasion of the blade point.

Furthermore, although it is basically preferred that the cutting edge angle γ of the cutter blade 410 is sharp, an extremely sharp cutting edge angle γ is liable to cause the breakage of the edge portion, so that the cutting edge angle γ should be set to a value within a range of 20 degrees to 50 degrees. Further, it is preferred that the cutter blade 410 is formed of cemented carbide, because a cutter blade made of a normal tool steel or the like is readily abraded, and one made of ceramics is liable to be broken.

After the cutter blade 410 configured as above is mounted in the cutter-holding portion 452 of the cutter holder 450, a carriage 457 is mounted on the cutter holder 450. The carriage 457 is comprised of a board 457*a* including a holding portion 457*b* which is formed by bending part of the board 457*a* into a U-shape in cross section for covering the cutter blade 410 and holding the cutter holder 450, a drooping piece 457*c* drooping from the board 457*a*, and an engaging projection 457*d* projecting from the lower end portion of the drooping piece 457*c* at right angles to the same in a direction away from the holding portion 457*b*.

The holding portion 457*b* has an urging projection 457*e* arranged on an inner surface opposed to the cutter blade 410. The cutter blade 410 is urged by the urging projection 457*e* to thereby enhance the mounting strength of the cutter blade 410. Further, the engaging projection 457*d* has an end formed with a retaining portion 457*f* for retaining the engaging projection 457*d* in an elongated slot 493 formed in an end portion of the input arm 490, referred to hereinafter. It should be noted that the engaging projection 457*d* is formed such that it protrudes in parallel with the rotational shaft 461 of the rotary disk 460, referred to hereinafter.

As shown in FIG. 17, the periphery of the sliding area of the cutter blade 410 in the tape-retaining member 420 is covered with a cutter cover 403. The cutter cover 403 includes a side plate 403*a* for covering a portion opposed to the side plate 423 of the tape-retaining member 420, and a side plate 403*b* for covering a portion opposed to the tape reception plate 440.

The side plate 403*a* has a slit 403*c* formed vertically therein such that it extends over a range of sliding of the drooping piece 457*c* of the carriage 457. The side plate 403*b* prevents the tape material 210 from entering the leading end of the tape-retaining member 420, and also serves as a retaining surface for retaining the tape material 210 when the cutter blade 410 performs a cutting operation.

Arranged at a vertically intermediate portion of the side plate 403*b* and at a location opposed to the discharge roller 510 of the tape discharge means 500, referred to hereinafter, is a holding plate 403*d* in a manner projecting perpendicularly to the side plate 403*a* such that the tape material 210 can be sandwiched between the same and the discharge roller 510. Further, at the lower end portion of the side plate 403*b*, there is formed a cutter-protecting portion 403*e* projecting perpendicularly to the side plate 403*b* such that the cutter-protecting portion 403*e* overlaps the blade face of the cutter blade 410 at the outside of the tape material 210 (cutting wait position of the cutter blade 410) in the direction of the width of the tape material 210 being fed. Since the cutter-protecting portion 403*e* is arranged at the cutting wait position of the cutter blade 410, the cutter-protecting portion 403*e* does not obstruct the feed of the tape material 210. Further, the cutter-protecting portion 403*e* protrudes forward of the blade point 412 of the cutter blade 410 for being fitted in the escape hole 445 of the tape reception plate 440. By providing the cutter cover 403 constructed as above, it is possible to prevent jamming of the leading edge of the tape material 210, guard the cutter blade 410 (e.g. by coping with external intrusion of foreign matter), and prevent intrusion of chips of the tape material 210.

Figure 24:
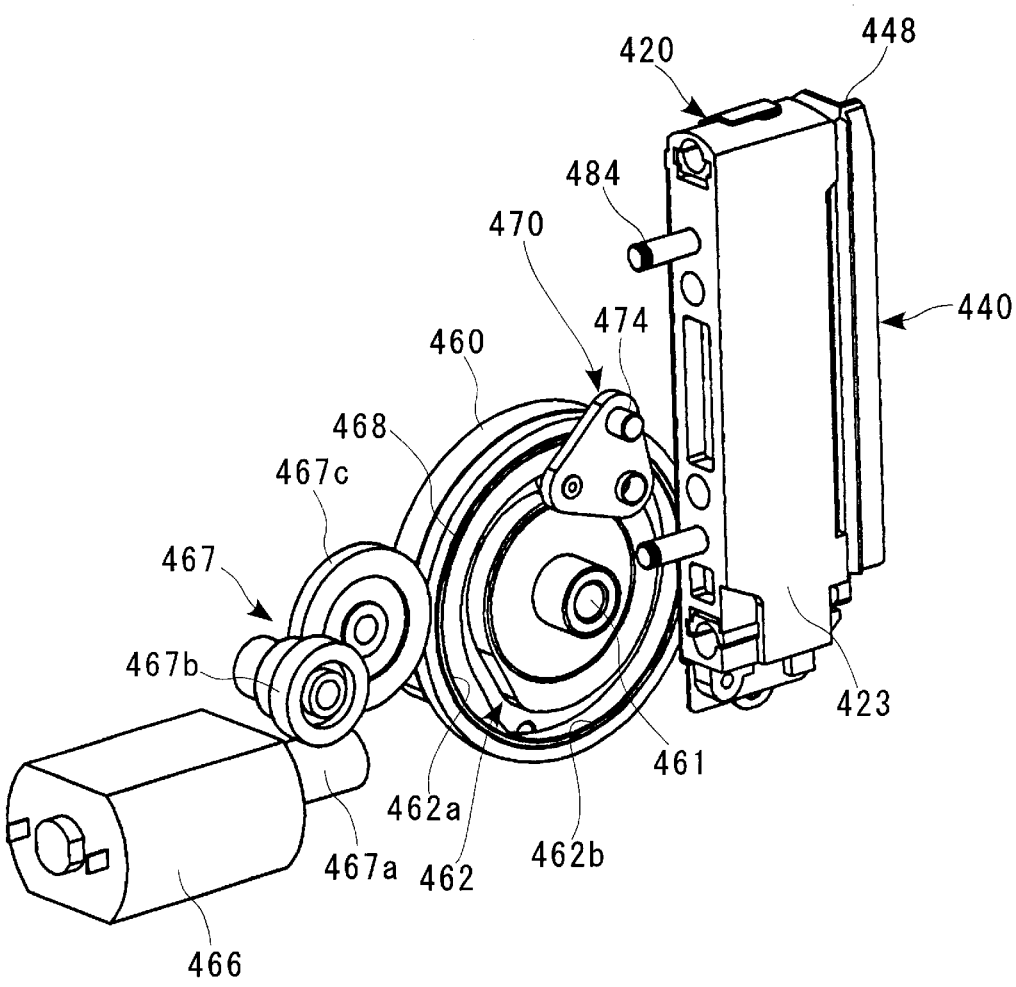
FIG. 24 is a diagram useful in explaining the arrangement of the cutter actuation mechanism of the half-cutting means.

Referring to FIGS. 9 and 24, the rotary disk 460 rotates about the rotational shaft 461 extending in a direction orthogonal to the direction of motion of the tape-retaining member 420 toward or away from the tape reception plate 440, and has an end cam groove 462 formed in one end surface thereof and a crank projection 463 formed on the other end surface at a location toward the periphery thereof. Further, the rotary disk 460 has a peripheral surface formed with a detection recess 464 which forms cutter home position detection means together with a cutter home position sensor 465 comprised e.g. of a micro-switch and the like, arranged in the vicinity of the periphery of the rotary disk 460.

The rotational shaft 461 extends through the rotational shaft insertion hole 489 of the support block 480, described hereinafter, and as shown in FIG. 6, has an end portion thereof rigidly fitted in the attachment reference face 170*a* of the cutter frame portion 170. The end cam groove 462 is formed by a small-diameter arcuate groove 462*a* and a large-diameter arcuate groove 462*b* having a diameter larger than the small-diameter arcuate groove 462*a* which are continuously arranged to form a generally annular shape. The end cam groove 462 enables the support block 480, referred to hereinafter, to perform intermittent reciprocating linear motion (motion toward or away from the tape reception plate 440). The cutter home position detection means can detect the position of the detection recess 464 by the cutter home position sensor 465, thereby determining a cutter home position in which the cutter blade 410 is in a cutting wait state.

As shown in FIG. 24, the drive mechanism of the rotary disk 460 is comprised of a half-cutting drive motor 466 and a gear train 467 for transmitting torque thereof to the rotary disk 460. The gear train 467 is comprised of a worm gear 467*a*, a worm wheel 467*b* and an intermediate gear 467*c*. Torque of the intermediate gear 467*c* is transmitted to the rotary disk 460 by a drive gear 468 integrally formed with the rotary disk 460. It should be noted that as shown in FIG. 6, the half-cutting drive motor 466 is arranged on the cutter-supporting frame 160, while the gear train 467 is arranged on a drive block-mounting frame 176 which is formed by bending part of the cutter-supporting frame 160 at right angles.

As described hereinabove, the half-cutting means 400 includes the half-cutting drive motor 466 exclusively provided therefor and the gear train 467 which is a transmission mechanism therefor. The full-cutting means 300 as well has the full-cutting drive motor 330 exclusively provided therefor and the gear train 331. As a result, the full-cutting means 300 and the half-cutting means 400 can be driven completely independently of each other, which increases the freedom of combination of full-cutting and half-cutting. Further, the service life of their cutter blades can be increased since cutting operation is carried out only when either of the full-cutting and the half-cutting is required.

Referring to FIGS. 9, 15 and 16, the input plate 470 has a board 471 having a triangular or like outer shape. The board 471 has a cam projection 472 erected on one surface, and a support shaft 473 and an engaging projection 474 erected on the other or back surface. The cam projection 472 is engaged with the end cam groove 462 of the rotary disk 460 to form an end cam mechanism together with the rotary disk 460.

The support shaft 473 extends through the horizontally elongated slot 488*b* of the support block 480, referred to hereinafter, and is arranged in parallel with the rotational shaft 461 of the rotary disk 460 to be rigidly fixed to the cutter frame portion 170. The input plate 470 is configured such that it can be pivotally moved about the axis of the support shaft 473. Further, The engaging projection 474 is fitted in the engaging recess 488*a* of the support block 480 in a vertically movable manner.

As shown in FIGS. 9, 15 and 16, the support block 480 has a flange 482 formed at an end portion of a board 481 on the side of the tape-retaining member 420 vertically in a direction perpendicular to the board 481. The flange 482 is opposed to the side plate 424 of the tape-retaining member 420 in a manner spaced therefrom and has upper and lower portions thereof connected to the side plate 424 by connection pins 483.

The above connection pins 483 are arranged in the direction of sliding of the tape-retaining member 420. Each connection pin 483 has one end rigidly fixed to the side plate 424, and the other end slidably extending through the flange 482 of the support block 480 with an end thereof formed with a retaining portion 484. This makes it possible to connect the support block 480 and the tape-retaining member 420 to each other in a manner movable toward or away from each other. Further, the lower connection pin 483 is caused to protrude in the rotational shaft insertion hole 489, referred to hereinafter, which receives the rotational shaft 461 of the rotary disk 460 therein, with the end thereof being formed with the retaining portion 484.

Further, the side plate 424 of the tape-retaining member 420 has spring-housing holes 485*a* which extend up to the respective blade-positioning members 430 accommodated in the tape-retaining member 420, and a required number of spring-housing holes 485*b* formed at intermediate locations between the spring-housing holes 485*a*. Arranged between the above spring-housing holes 484*a* and 485*b* and the flange 482 of the support block 480 are springs 486*a* and 486*b* respectively in a resilient manner. As described above, one end of each of the springs 486*a* is brought into abutment with the spring reception surface 431 of the blade-positioning members 430.

As described hereinabove, the tape-retaining member 420 and the pair of blade-positioning members 430 are urged independently of each other toward the tape reception plate 440 by the springs 486*a* and 486*b*, and operate without having any effect on each other, so that the reliability of the function of each device can be enhanced.

Further, the board 481 of the support block 480 has horizontally elongated slots 487 arranged at required positions therein, so that, as shown in FIG. 6, the support block 480 is slidably attached to the attachment reference face 170*a* of the cutter frame portion 170 by pins or the like such that it can move toward or away from the tape reception plate 440. Further, the board 481 has an input plate-mounting recess 488 arranged therein such that the input plate 470 can be mounted on the board 481 in a manner placed upon the input plate-mounting recess 488. The input plate-mounting recess 488 is formed with a vertically elongated engaging recess 488*a* and a horizontally elongated slot 488*b* arranged below the engaging recess 488*a*. The input plate-mounting recess 488 is larger in size than the outer shape of the input plate 470 such that the input plate 470 can be pivotally moved in the input plate-mounting recess 488. Further, the board 481 has the rotational shaft insertion hole 489 formed below the input plate-mounting recess 488, for receiving the rotational shaft 461 of the rotary disk 460 therethrough.

In the support block 480, the input plate 470 is fitted in the recess 488, the support shaft 473 extends through the horizontally elongated slot 488*b* for being rigidly fixed to the cutter frame portion 170, and the engaging projection 474 is fitted in the engaging recess 488*a*. This enables the input plate 470 to receive the torque of the rotary disk 340 to be pivotally moved about the axis of the support shaft 473 in a direction indicated by arrow A, as shown in FIG. 9.

At this time, the engaging projection 474 transmits a driving force in the direction of horizontal slide to the support block 480 via the engaging recess 488*a* while vertically moving in the engaging recess 488*a*. Therefore, the pivotal force of the input plate 470 can be converted to reciprocating linear motion in a direction orthogonal to the direction of the rotational shaft 461 of the rotary disk 460 by the support block 480. Although the support shaft 473 and the rotational shaft 461 of the rotary disk 460 are rigidly fixed, they are fitted in the horizontally elongated slot 488*b* and the rotational shaft insertion hole 489, respectively, and hence the support shaft 473 and the rotational shaft 461 do not obstruct the reciprocating linear motion of the support block 480.

When the support block 480 performs reciprocating linear motion, the connection pins 483 transmit the motion, whereby the tape-retaining member 420, the cutter blade 410 which is mounted on the guide shaft 402 held by the tape-retaining member 420 via the cutter holder 450, and the blade-positioning members 430 rigidly fixed to the upper and lower end portions of the guide shaft 402 follow the motion of the support block 480 to perform reciprocating linear motion such that they can be moved toward or away from the tape reception plate 440.

Therefore, the tape-retaining member 420 can urge the tape material 210 against the tape reception plate 440, and at the same time stop urging the same. Further, the blade-positioning members 430 are brought into abutment with the tape reception plate 440, whereby it is possible to place the cutter blade 410 at a cutting operation position located at a predetermined distance from the tape reception plate 440. At this time, since the pair of blade-positioning members 430 are brought into abutment with the tape reception plate 440 at upper and lower portions, it is possible to always stably secure a distance from the cutter blade 410 to the tape reception plate 440 even if structures e.g. of the tape reception plate 440 and the like are deformed.

Furthermore, the urging forces of the springs 486*a* are transmitted to the cutter holder 450 via the blade-positioning members 430 and the guide shaft 402 to place the cutter holder 450 in a floated state, whereby the cutter blade 410 can be elastically engaged in the tape material 210. As a result, even when the tape material 210 is made uneven or irregular along irregularity of the tape reception surface 441 of the tape reception plate 440, the cutter blade 410 can exhibit a cutting performance with a wide stable operation range against variations in the rigidity of the tape material 210 and the engaging pressure of the cutter blade 410.

Further, since the cutter blade 410 pushes the tape material 210 against the tape reception plate 440 in a cantilever manner, deformation of the tape reception plate 440 can be prevented, thereby increasing the cutting accuracy of the cutter blade 410. Further, the cutter blade 410 cuts the tape material 210 in a sliding manner, so that it can cut the tape material 210 with an extremely weak force, which contributes to attaining energy saving and a compact construction of the tape printing apparatus as well as reliable cutting operation thereof. Further, since only the printing tape 211 (receptor) is cut off, it is easy to handle completed labels formed by continuous printing, printing with serial numbers, and the like.

As shown in FIGS. 9 and 14, the input arm 490 has a root end thereof supported on an outer surface of the drive block-mounting frame 176 by a support shaft 491 which is parallel with the rotational shaft 461 of the rotary disk 460. The input arm 490 has an intermediate portion formed with a crank slot 492 which is engaged with the crank projection 463 projecting from the rotary disk 460 to form a swinging crank mechanism together with the rotary disk 460. Further, the input arm 490 has the end portion thereof formed with the elongated slot 493 extending along a direction of swinging radius of the input arm 490.

The crank slot 492, which is formed along the direction of swinging radius of the input arm 490, has an intermediate portion thereof formed with a driving force-non-transmitting portion 494 which is not capable of transmitting the rotational motion of the rotary disk 460, and only opposite ends thereof formed with driving force-transmitting portions 495 and 496 which are capable of transmitting the rotational motion of the rotary disk 460.

Further, the engaging projection 457*d* of the carriage 457 mounted in the cutter holder, described above, is slidably fitted in the elongated slot 493 formed in the end portion of the input arm 490, such that it can slide in the direction of swinging radius of the input arm 490.

Figure 10:
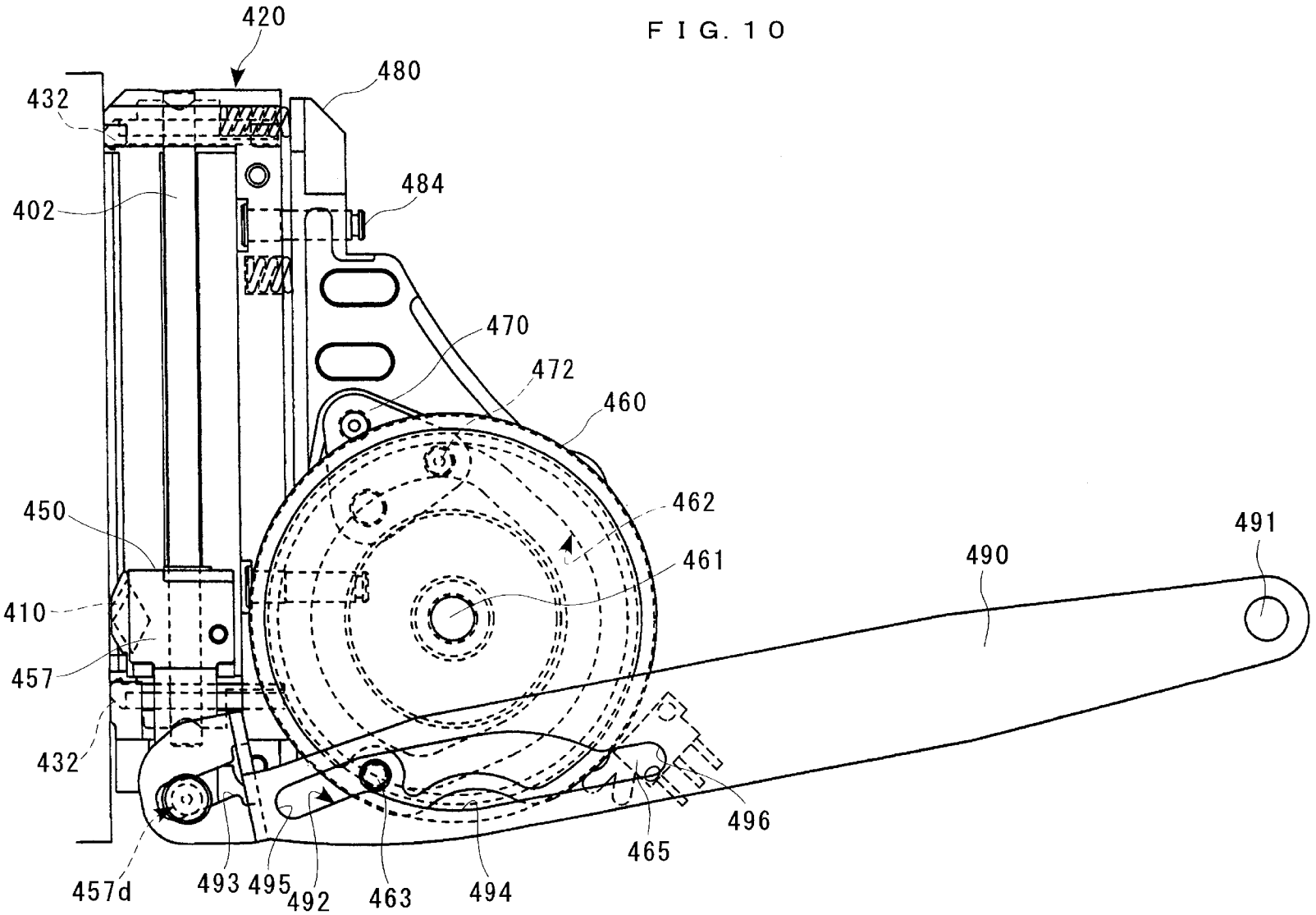
FIG. 10 is a diagram useful in explaining the construction of the cutter actuation mechanism of the half-cutting means.
Figure 11:
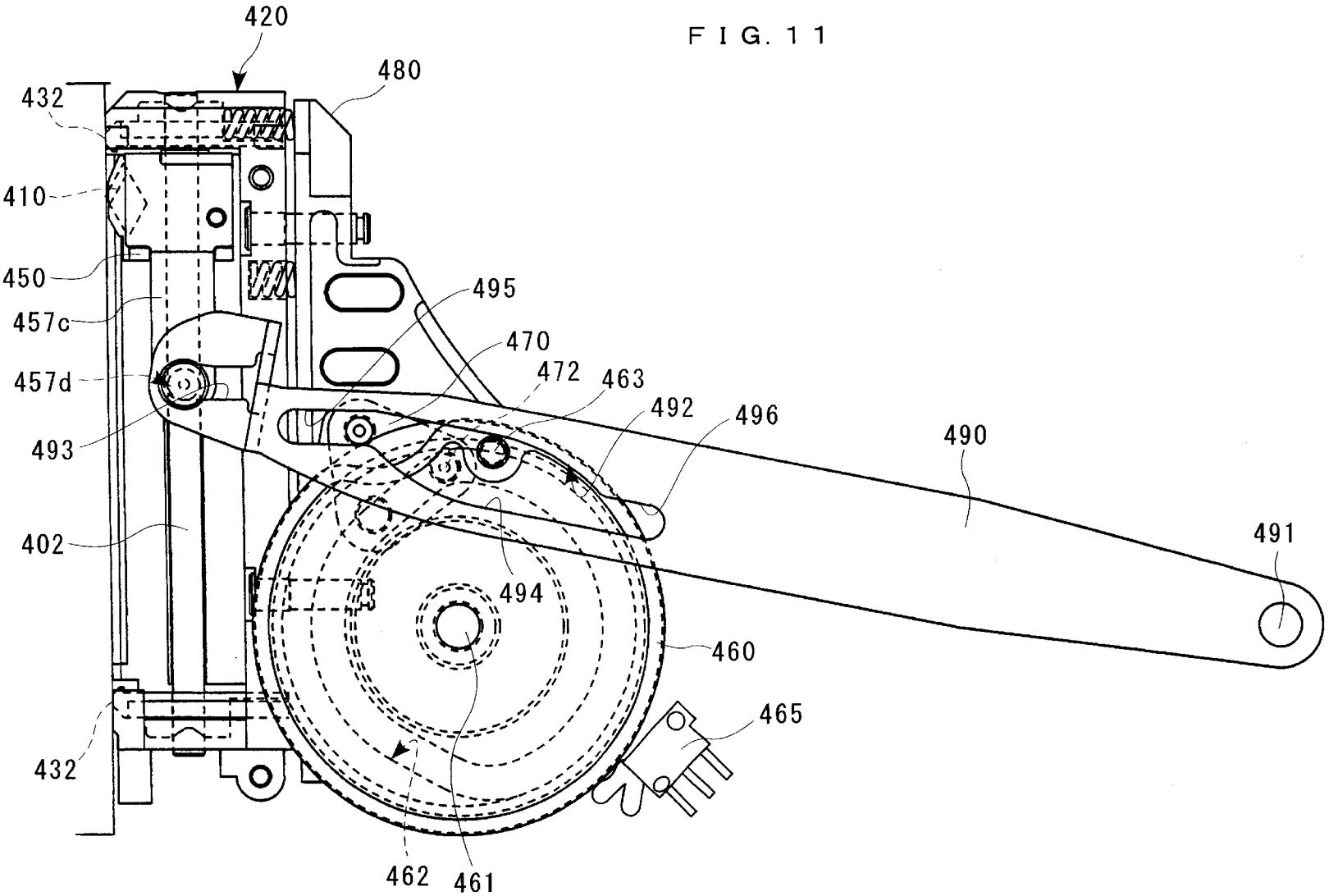
FIG. 11 is a diagram useful in explaining the construction of the cutter actuation mechanism of the half-cutting means.

Therefore, when the half-cutting drive motor 466 operates to drive the rotary disk 460 for rotation via the gear train 467, as shown in FIGS. 10 and 11, the crank projection 463 is pivotally moved in a state engaged with the driving force-transmitting portion 495 of the crank slot 492, thereby making it possible to convert the rotational motion of the rotary disk 460 to an upward pivotal motion of the input arm 490 from below. Further, the pivotal motion of the input arm 490 is converted to an advancing linear motion of the cutter holder 450 in which the cutter holder 450 is moved upward along the guide shaft 402, thereby enabling the cutter blade 410 to perform a cutting operation.

Figure 12:
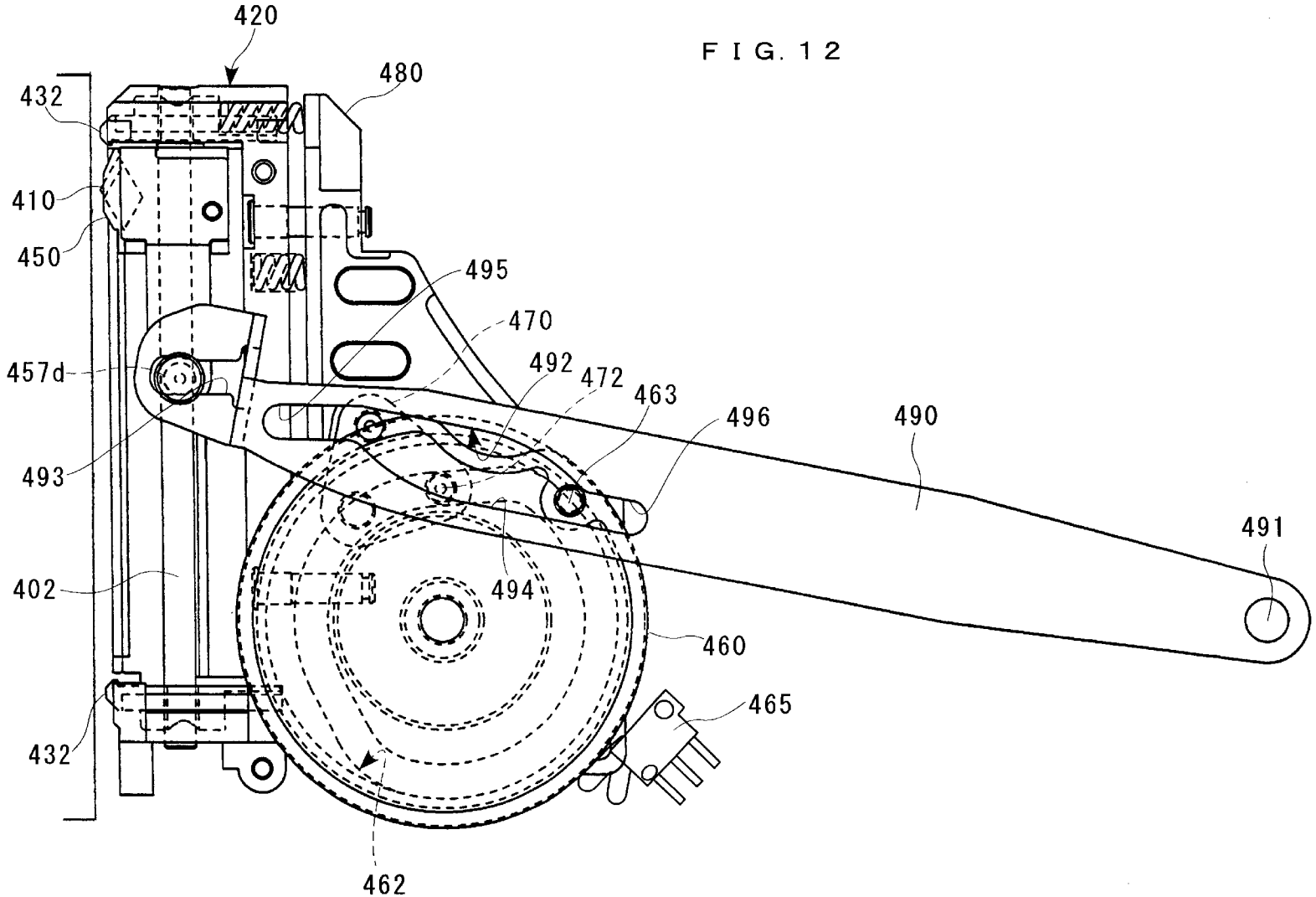
FIG. 12 is a diagram useful in explaining the construction of the cutter actuation mechanism of the half-cutting means.

Further, as shown in the sequence of FIGS. 12 and 9 in the mentioned order, when the crank projection 463 is caused to pivotally move in a state engaged with the driving force-transmitting portion 496, the rotational motion of the rotary disk 460 can be converted to the downward pivotal motion of the input arm 490 from above. Further, the pivotal motion of the input arm 490 is converted to a returning linear motion of the cutter holder 450 in which the cutter holder 450 is moved downward along the guide shaft 402. As shown in FIGS. 9 and 11, when the crank projection 463 is located on the driving force-non-transmitting portion 494, the cutter holder 450 is stopped, halting both the upward motion and the downward motion thereof, which makes it possible to cause the cutter holder 450 to perform intermittent upward/downward motion.

Further, when the rotary disk 460 rotates, as described hereinabove, the tape-retaining member 420, the cutter holder 450, and the blade-positioning members 430 are intermittently moved toward or away from the tape reception plate 440 by the input plate 470 and the support block 480. Hence, the motions of the tape-retaining member 420, the cutter holder 450, and the blade-positioning members 430, and the upward/downward motion of the cutter holder 450 are interlocked with each other such that the motions can be alternately carried out, as shown in the sequence of FIGS. 9 to 12 in the mentioned order.

First, FIG. 9 shows a state in which the tape-retaining member 420 has released the tape material 210, and feed printing is being carried out for feeding and printing the tape material 210. In the figure, the cutter blade 410 is located at the cutting wait position thereof remote from the lower end portion of the tape reception plate 440. Referring to FIG. 10, next, the rotary disk 460 is rotated to move the support block 480 toward the tape reception plate 440 via the input plate 470. This enables the tape-retaining member 420 to hold the tape material 210 between the same and the tape reception plate 440 for fixing the tape material 210. Further, the cutter blade 410 is moved to a cutting start position at a location close to the tape reception plate 440 to make itself ready for cutting operation. In this state, the pair of blade-positioning members 430 are in abutment with the tape reception plate 440, whereby the cutter blade 410 is positioned.

Next, as shown in FIG. 11, when the rotary disk 460 is rotated, the cutter blade 410 is caused to slide upward by the input arm 490 to cut the tape material 210. Next, as shown in FIG. 12, the support block 480 is caused to leave the tape reception plate side thereof to cause the tape-retaining member 420 and the cutter blade 410 to withdraw in a manner following the support block 480, whereby the tape material 210 is released from the tape-retaining member 420 again, thereby making it possible to carry out feed printing. Further, the cutter blade 410 performs a removal operation until it reaches to a predetermined withdrawn position.

Finally, as shown in FIG. 9, a cutter blade-returning operation is carried out in which the rotary disk 460 is rotated, and the cutter blade 410 is caused to slide downward via the input arm 490 to be returned from the withdrawn position to the cutting wait position. The above operations are repeatedly carried out in a cyclic manner, whereby it is possible to execute the cutting operations.

As described above, since complicated cyclic cutting operations can be carried out by using torque of one rotary disk 460, it is possible not only to execute the cutting operations efficiently by the simple mechanism but also to accurately synchronize the cutting operations with each other. Further, the tape material 210 is cut off upward from below, and the cutter blade 410 is caused to be located at a position below the tape material 210 where it is on standby for cutting operation. This makes it possible to prevent the cutter blade 410 from abutting against the tape material 210 when the tape material 210 is replaced by another. Furthermore, the tape material 210 tends to be displaced upward during printing operations (since the platen roller 220 and the print head 150 has an open top space therebetween). Although in this case, the tape material 210 can be displaced if it is cut from above to below, the tape material 210 has already been brought into abutment with the top of a cartridge casing or the like, and hence if cut upward from below, the tape material 210 is not displaced or undesirably moved by the cutting operation.

Referring to FIG. 1, the tape discharge means 500 is arranged between the half-cutting means 400 and the tape exit 110 for forcibly discharging the tape material 210 cut off by the full-cutting means 300, from the tape exit 110. For instance, as shown in FIGS. 5, 7, and 8, the tape discharge means 500 has the discharge roller 510 which is arranged on the side of the peel-off paper 212 of the tape material 210, and rotates in a direction of discharge of the tape material 210 in a state in contact with the tape material 210.

This discharge roller 510 is comprised of a rotational base portion 511 and a tape discharge portion 512 arranged at a lower portion thereof. The tape discharge portion 512 is formed by a plurality of drooping pieces 513 drooping from the periphery of the rotational base portion 511. The group of drooping pieces 513 are widened toward the ends thereof by centrifugal force generated by the rotation of the discharge roller 510, and discharges or flicks the cut-off strip of the tape material 210 out of the apparatus via the tape exit 110.

Further, the discharge roller 510 is arranged on the side of the back-surface 446 of the tape reception surface 441 (at a position opposed to the half-cutting means 400) such that it faces toward the cutter blade side via the cut-away portion 443 formed in the tape reception plate 440. The discharge roller 510 sandwiches the tape material 210 between the same and the holding plate 403*d* formed on the cutter cover 403 and a discharge sub-roller 514 arranged in a manner opposed to the discharge roller 510, for promoting discharge of the tape material 210.

Figure 7:
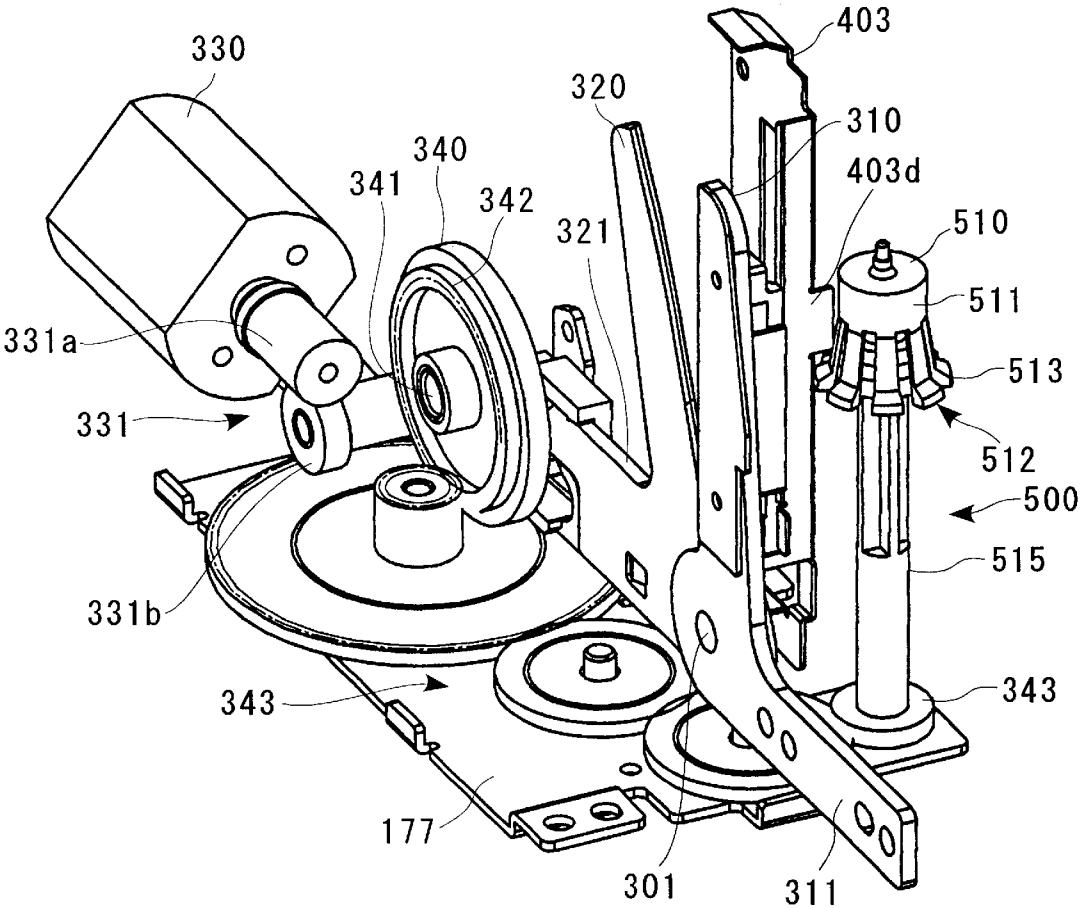
FIG. 7 is a perspective view showing a full-cutting means and a tape discharge means.

Further, as shown in FIG. 7, the discharge roller 510 is supported by a rotational shaft 515 projecting from a full cutter support frame 177, and shares the full-cutting drive motor 330 and the gear train 331 as its drive mechanism with the full-cutting means 300. Further, the torque of the full-cutting drive motor 330 is transmitted to the discharge roller 510 via a transmission gear 342 integrally formed with the rotary disk 340, a gear train 343, and a drive gear 343 integrally formed with the lower end of the rotational shaft 515. That is, when the full-cutting drive motor 330 operates, torque thereof is branched by the rotary disk 340, and hence discharge operation of the tape discharge means 500 can be made synchronous with cutting operation of the full-cutting means 300 (by operation synthesis mechanism) such that the discharge operation is executed only when the full-cutting operation is being carried out.

Therefore, the tape discharge means 500 is caused to operate only during execution of the full-cutting operation, by the above operation synchronizing mechanism, and hence a tensile force is not applied to the tape material 210 when printing or half-cutting is being executed. This prevents the tensile force from exerting adverse effects on the printing or half-cutting of the tape material 210. Further, the tape discharge means 500 is arranged on the peel-off paper side, whereby it is possible to easily discharge the tape material 210 along curling of the tape material 210 as well as prevent occurrence of damages and stains in a printed surface of the printing tape 211 since the printing tape 211 is not flicked.

Further, since the tape discharge means 500 and the half-cutting means 400 are arranged in a manner opposed to each other, the distance therebetween can be decreased, so that a discharging margin can be reduced in size, thereby minimizing the waste of the tape material 210. Especially, since the discharge roller 510 is configured such that it is caused to intrude into the cut-away portion 443 of the tape reception plate 440, it is possible to further reduce the waste of the tape material 210. Furthermore, the layout of the full-cutting means 300, the half-cutting means 400 and the tape discharge means 500 arranged from the upstream side to the downstream side in the mentioned order can minimize the distance between the position where the print head 150 is arranged and the full-cutting position, thereby enabling reduction of the waste of the tape material 210.

Figure 25:
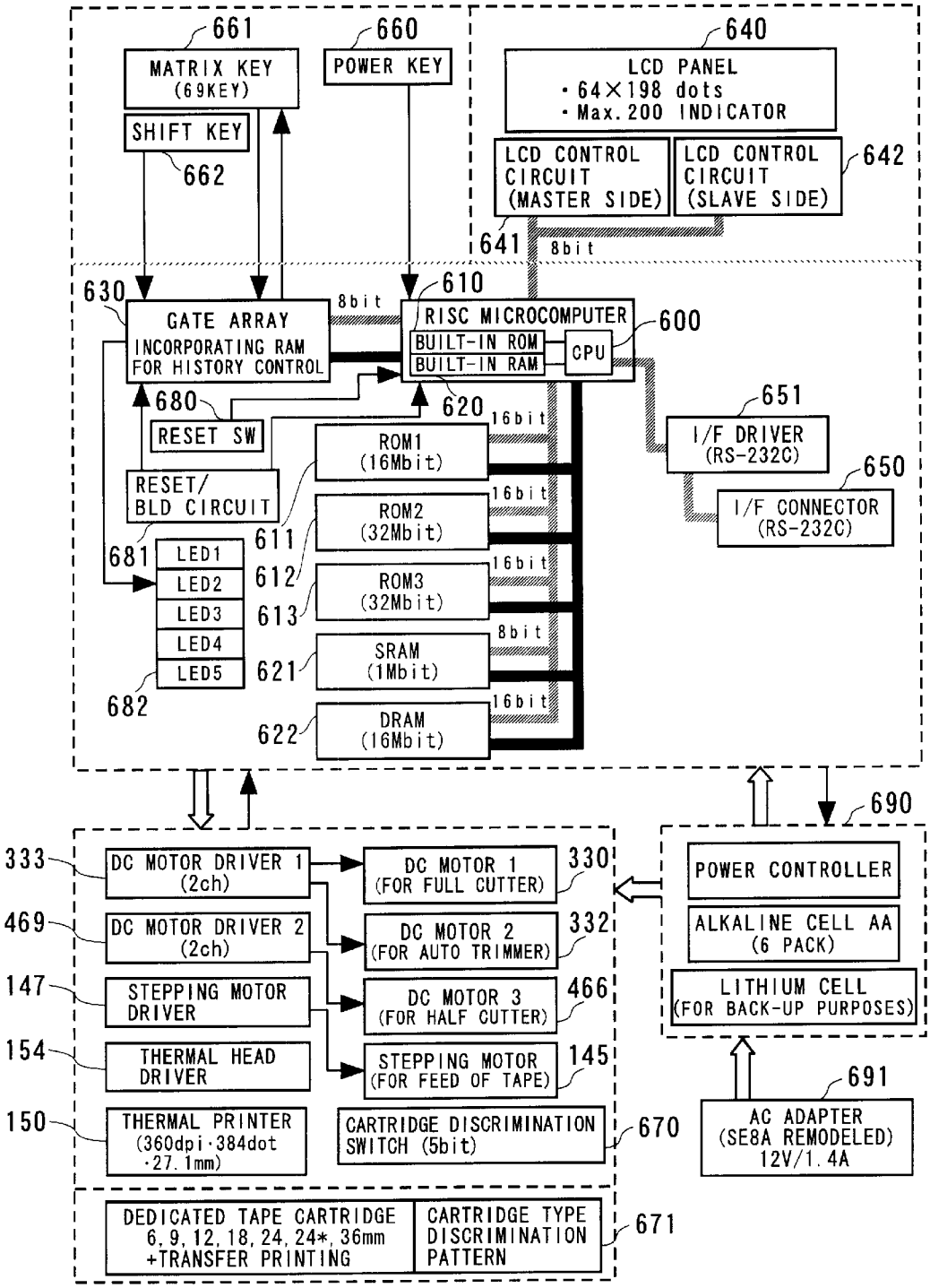
FIG. 25 is a block diagram showing the arrangement of the tape printing apparatus according to the embodiment.

FIG. 25 is a block diagram showing the arrangement of the tape printing apparatus according to the embodiment of invention. Connected to a CPU 600 incorporated in a RISC (Reduced Instruction Set Computer) microcomputer, are a built-in ROM 610, external ROMs 611 to 613, a built-in RAM 620, an external SRAM (Static RAM) 621, and an external DRAM (Dynamic RAM) 622. Each ROM stores programs and a character generator for display and printing. Each RAM stores buffers for editing, display and printing, a work area, a stack area, settings of character heights, settings of character widths, settings of character modifications, settings of inter-character spaces, settings of tape lengths, settings of front/rear margins, selections of fonts, repeat settings, and the like. Each RAM further stores input print data, the length of one strip of tape material 210 calculated based on the print data to be separated from another strip by half-cutting, the length of one strip of tape material 210 to be separated from another strip by full-cutting.

Further, connected to the CPU 600 are a gate array 630 incorporating a RAM for history control, an LCD panel (liquid crystal display device) 640, an LCD control circuit (on the master side) 641 and an LCD control circuit (on the slave side) 642 for controlling the LCD panel 640, an interface connector 650, an interface driver 651, and a power key 660. The gate array 630 has a matrix key 661 and a shift key 662 connected thereto. Further, also connected to the CPU 600 are the full-cutting drive motor (DC motor) 330 for the full-cutting means (full cutter), a DC motor 332 for an auto trimmer, the half-cutting drive motor (DC motor) 466 for the half-cutting means (half cutter), and the drive motor (stepping motor) 145 for feeding a tape material, via respective drivers 333, 469, and 147. Furthermore, the CPU 600 is connected to a thermal printer 150 via a thermal head driver 154, as well as to a tape cartridge determination switch 670 and a tape cartridge type determination pattern 671. Further, a reset switch 680 is connected to the CPU 600, a reset BLD (Battery Life-span Display) circuit 681 is connected to the CPU 600 and the gate array 630, and a display LED 682 is connected to the gate array 630. A power controller 690 and an AC adapter 691 are connected to the motors and the CPU 600.

The CPU 600 provides control means for carrying out centralized control of the devices, and capable of causing the half-cutting means 400 to carry out cutting operation prior to the full-cutting means 300. Further, the CPU 600 is capable of controlling the full-cutting means 300, the half-cutting means 400, tape feed means comprised of the platen roller rotational shaft 143 and the platen roller 220, and printing means including the print head 150, independently of each other.

Next, a feed printing method will be described with reference to FIGS. 26 and 27. First, print data for printing, format data, such as character sizes, inter-character spaces, the number of lines, front and rear margins, and the like, print element set data for printing on a tape material, which includes separation data used for half-cutting every strip of the tape material on which one print element is printed, and print set count data indicative of the number of sets of print elements to be printed according to the print element set data is input via an input block such as the matrix key 661. Then, after the start of a printing operation based on the print element set data is instructed, a printing process is started.

Now, the CPU 600 controls the tape feed means and the half-cutting means 400 such that half-cutting is carried out on a printed label-forming portion of the tape material 210, which is to be full-cut by the full-cutting means 300, while providing a peel-off paper-peeling margin for use in peeling off the peel-off paper from an upstream end of the portion in the direction of feed of the tape material 210. Further, the CPU 600 controls the tape feed means, the print head 150, and the half-cutting means 400 such that a sum total of the peel-off paper-peeling margin and the front margin of a printed portion is equal to or larger than a distance between the print head 150 and the full-cutting means 300. Furthermore, when a plurality of print elements are printed continuously without being cut off from each other, the CPU 600 controls the full-cutting means 300 and the half-cutting means 400 such that the boundary line portions of the respective print elements are cut only by the half-cutting means 400 while canceling the cutting off of each print element by the full-cutting means and setting of the peel-off paper-peeling margin.

When the printing process is started, first, print data required for printing the input count or number of sets of print elements is formed and stored in the RAM as image data for printing, at a step S100, and further, the length of one strip of the tape and the length of a portion of the tape for the one set of print elements are determined as data setting a half-cutting position and a full-cutting position, respectively, based on the count of characters, character sizes, line spaces, and margins, and stored in other areas of the RAM. Feed printing is carried out on the tape material 210 based on the image data and tape length data obtained from the above print data at a step S101.

Figures 26A, 26B, 26C, 26D, 26E, 26F:
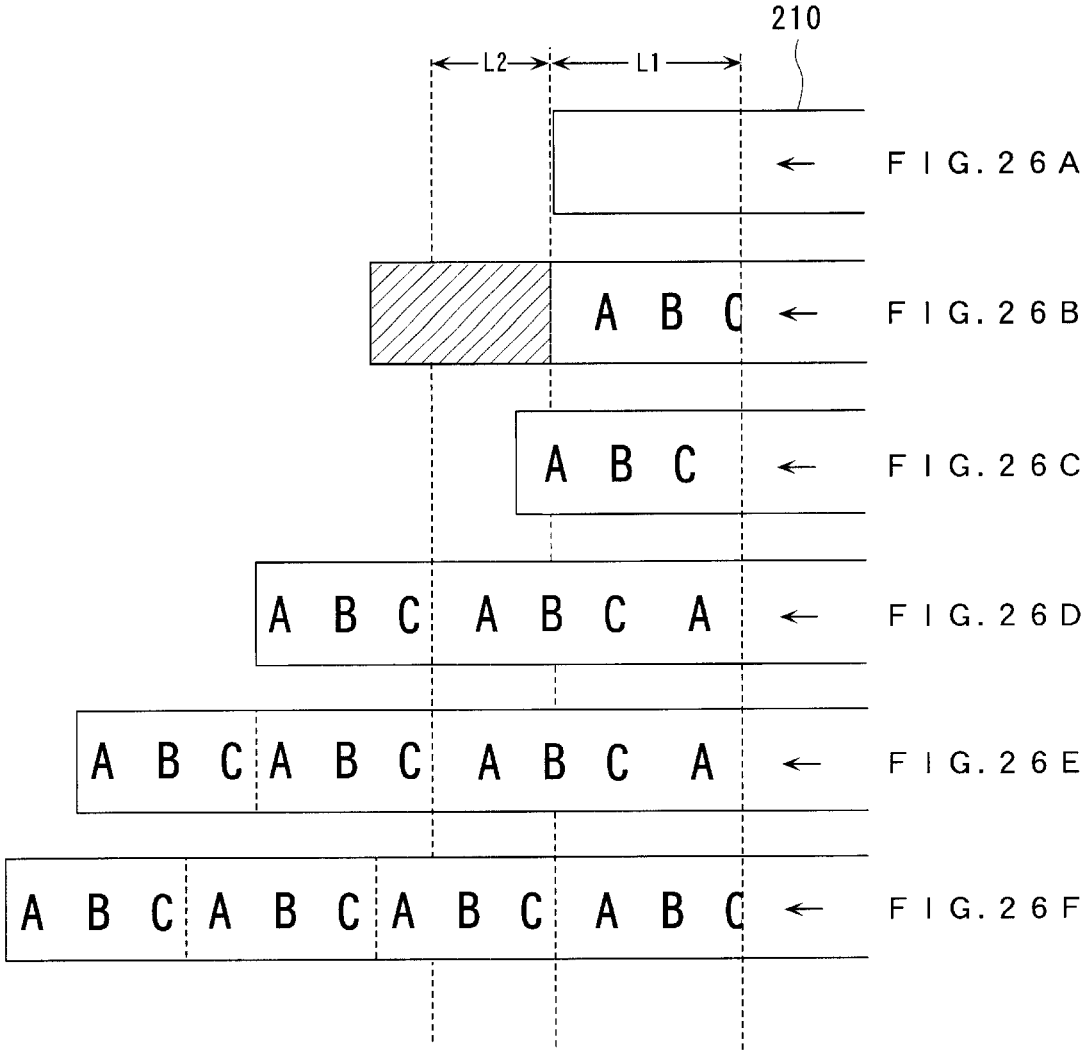
FIG. 26 is a diagram which is useful in explaining a printing method carried out by the tape printing apparatus according to the embodiment.
Figure 27:
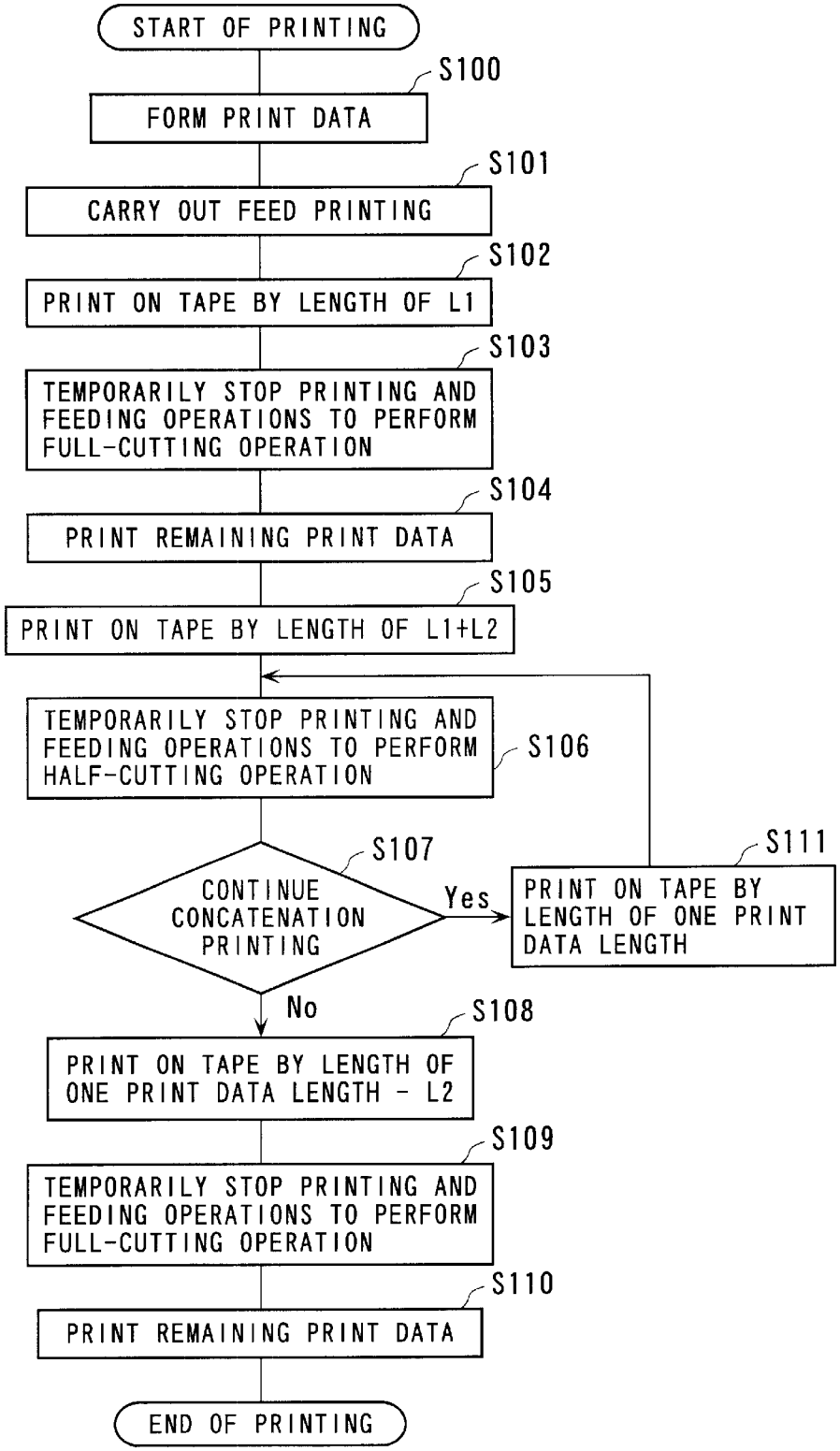
FIG. 27 is a flowchart showing the printing method carried out by the tape printing apparatus according to the embodiment.

In FIGS. 26A to 26F, L1 designates the distance between the print head 150 and the full-cutting means 300, and L2 designates a distance between the full-cutting means 300 and the half-cutting means 400. FIG. A shows a state of the tape material 210 before printing. From this state, a printing operation is started while feeding the tape, and the tape is printed by feed printing (printing carried out while feeding) by the length of L1 at a step S102, and then as shown in FIG. 26B, the printing operation and the tape feeding operation are suspended, and full-cutting is carried out by the full-cutting means 300 at a step S103 for cutting an unnecessary tape portion (hatched area in FIG. 26B). Next, as shown in FIG. 26C, the remaining portion of one print data (data of three characters of ABC in the illustrated example) is printed at a step S104. Then, as shown in FIG. 26D, after the feed printing is carried out by the length of (L1+L2) at a step S105, the printing operation and the tape feeding operation are suspended, and half-cutting is carried out by the half-cutting means 400 at a step S106.

Then, it is determined at a step S107 whether or not the above concatenation printing is further continued. If the concatenation printing is not continued, after the feed printing has been carried out by the length equal to the difference between the length of the one print data item and L2 at a step S108, the printing operation and the feeding operation are suspended, and full-cutting is carried out by the full-cutting means 300 at a step S109, whereby a label element is cut off which has the length of two print data (print elements) with a half-cut formed by the half-cutting means 400 at an intermediate location thereof, and the tape material 210 remains without the hatched area in FIG. 26B. Next, as shown in FIG. 26C, the remaining portion of the one print data item is printed at a step S110, followed by terminating the printing process. When the next printing process is started, it can be resumed from a state in which the tape material 210 has no unnecessary tape portion.

In the flow of the printing operations, at the step S107, if the concatenation printing is continued, the feed printing is performed by the length of the one print data item at a step S111, and then as shown in FIG. 26E, the printing operation and the feeding operation are suspended, and half-cutting is carried out by the half-cutting means 400 at the step S106. Next, it is determined again at the step S107 whether or not the concatenation printing is further continued. If the concatenation printing is not continued, as shown in FIG. 26F, the feed printing is carried out by the length equal to the difference between the length of the one print data item and L2 at the step S108, and thereafter the printing operation and the feeding operation are temporarily stopped for carrying out full-cutting by the full-cutting means 300 at the step S109. Thus, a label element is cut off which has the length of three print data with two half-cuts formed at intermediate locations thereof, and the tape material 210 remains without the hatched area in FIG. 26B. Next, as shown in FIG. 26C, the remaining portion of the one print data item is printed at the step S110, followed by terminating the printing process. When the next printing process is started, it can be resumed from the state in which the tape material 210 has no unnecessary tape portion. If the concatenation printing is further continued, the operations executed at the steps S107, S111 and S106 are repeatedly carried out.

Figure 28:
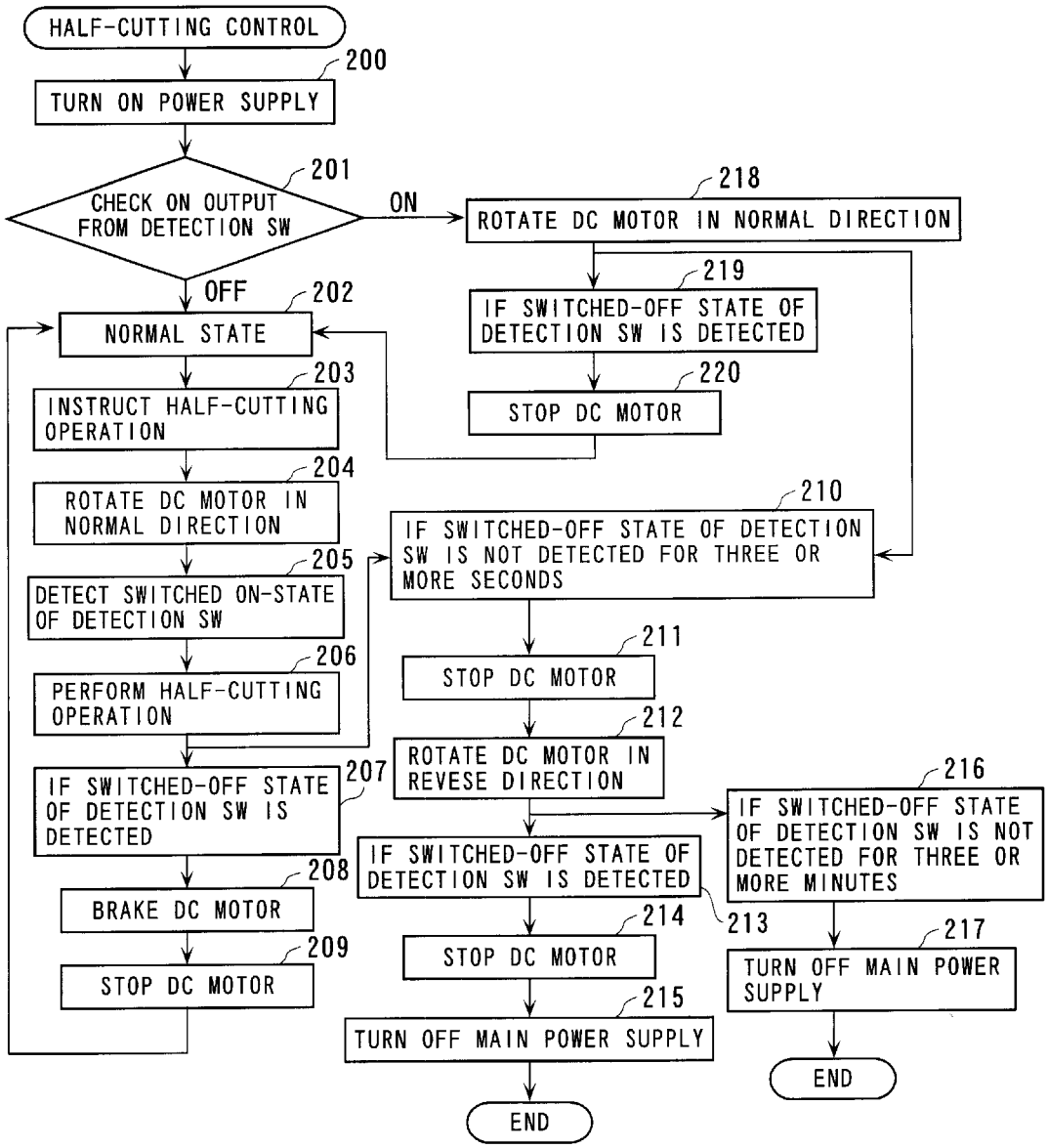
FIG. 28 is a flowchart showing a half-cutting control process executed by the tape printing apparatus according to the embodiment.

Next, a half-cutting control process will be described with reference to FIG. 28 showing a flowchart thereof. When the main power supply of the apparatus body 100 is turned on at a step S200, first, it is confirmed at a step S201 whether or not a detection signal is output from the cutter home position sensor 465. If the OFF state of the detection switch of the cutter home position sensor 465 is detected, the half cutter 401 is located in a normal state in a cutter home position in which the half cutter 401 is waiting for an instruction for carrying out half cutting, at a step S202. When the half cutting instruction is provided at a step S203, the DC motor starts to perform normal rotation at a step S204, the ON state of the detection switch of the cutter home position sensor 465 is detected at a step S205, and the half-cutting is carried out at a step S206. Next, when the OFF state of the detection switch is detected at a step S207, after execution of a DC motor brake control at a step S208, the DC motor is stopped at a step S209, and the half cutter 401 is returned to the normal state thereof for being made on standby.

The apparatus incorporates a timer for measuring a time period over which the half cutter 401 performs cutting operation. After the half-cutting operation has started at the step S206, if the OFF state of the detection switch is not detected for a predetermined time period (3 seconds, for instance) at a step S210, it means that the cutting operation of the half cutter 401 is abnormal, and hence the DC motor, after being stopped at a step S211, is driven for reverse rotation to cause the half cutter 401 to operate in the reverse direction at a step S212, whereby if the OFF state of the detection switch is detected at a step S213, the DC motor is stopped at a step S214, and then the main power supply is turned off at a step S215, followed by terminating the half-cutting control process.

Here, during execution of the control flow, if the OFF state of the detection switch is not yet detected within the predetermined time period at a step S216 after the start of the reverse rotation of the DC motor at the step S212, the main power supply is turned off immediately after the lapse of the predetermined time period at a step S217, followed by terminating the half-cutting control process.

Further, during the execution of the control flow, if it is confirmed at the step S201 whether or not the detection signal is output from the cutter home position sensor 465, and if the ON state of the detection switch of the cutter home position sensor 465 is detected, the half cutter 401 is not located in the cutter home position, so that the DC motor is driven for normal rotation to cause the half cutter 401 to operate in the normal direction at a step S218, whereby if the OFF state of the detection switch is detected at a step S219, the DC motor is stopped at a step S220 to place the half cutter 401 in the normal state at the step S202. After the half cutter 401 is caused to operate in the normal direction at the step S218, if the OFF state of the detection switch is not yet detected within the predetermined time period, the steps S210 et seq. are carried out.

Figure 29:
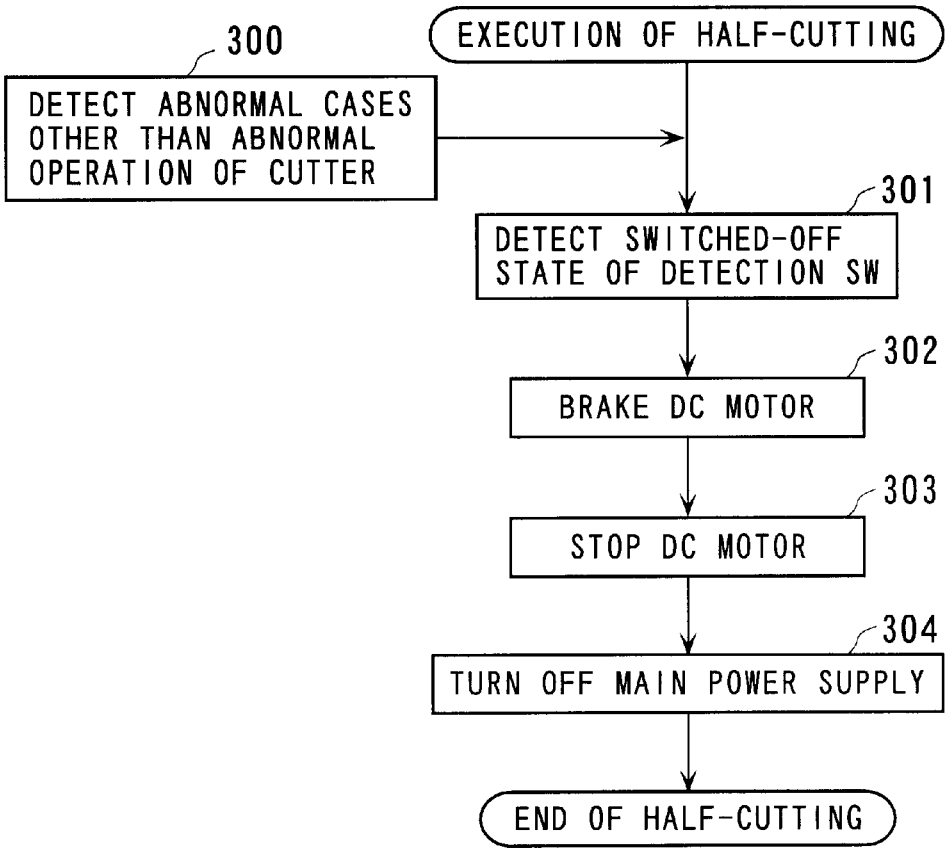
FIG. 29 is a flowchart showing the half-cutting control process executed by the tape printing apparatus according to the embodiment.

Further, the apparatus includes detection means for detecting occurrence of abnormal cases other than the abnormal operation of the half cutter 401. The abnormal cases include, for instance, a case in which it is detected that the lid of the cartridge is opened, a case of the power key being turned off due to an erroneous operation, a case of overheat of the print heat being detected, and the like. FIG. 29 shows a flow of the half-cutting control process executed when the above abnormal cases have occurred. First, when any of the abnormal cases is detected during execution of half-cutting by abnormal case detection means, a signal generated by the abnormal case detection means interrupt an execution flow of half-cutting at a step S300. In this case, the DC motor continues to be driven until the OFF state of the detection switch is detected, whereby the half cutter 401 is returned to the cutter home position at a step S301. After that, the DC motor brake control is carried out at a step S302, the DC motor is stopped at a step S303, the main power supply is turned off at a step S304, and the execution of half-cutting is completed.

Figure 30:
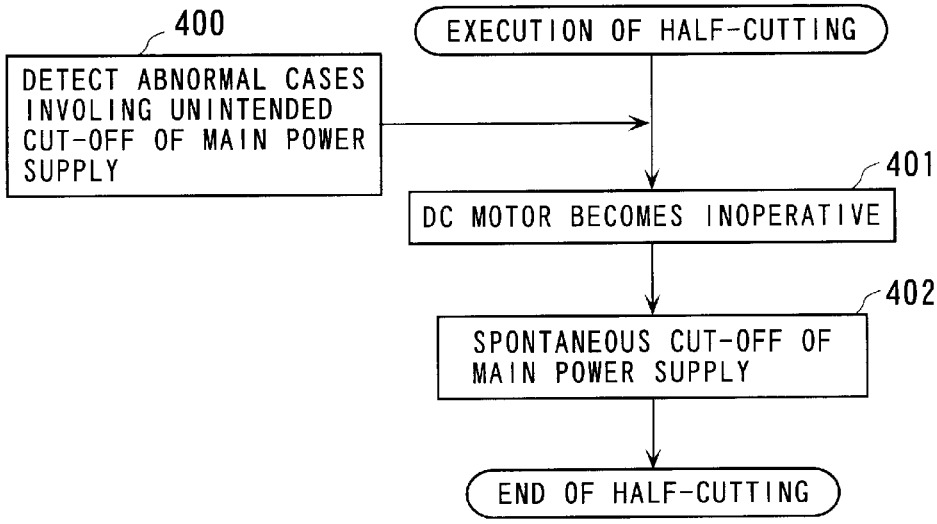
FIG. 30 is a flowchart showing the half-cutting control process executed by the tape printing apparatus according to the embodiment.

FIG. 30 shows a flow of the half-cutting control process executed when the service life of a battery becomes very short or when the power supply is interrupted due to pulling of a plug or a power failure. When any of such abnormal cases, as described above, caused by natural cutting of the main power supply is detected, a signal generated by the abnormal case detection means interrupts the execution flow of half-cutting at a step S400. In this case, no positive instruction for stopping the DC motor is provided, and the DC motor is left as it is. However, if there is restriction on hardware and software configurations (e.g. processing for preventing unstable state caused upon restoration of power), the system follows the restriction. The DC motor, when left as it is, becomes inoperative at a step S401, the main power supply is cut naturally at a step S402, and the execution of half-cutting is terminated.

As described hereinabove, by detecting both the position and operation time period of the cutter blade 410, if there occurs stoppage of the cutter blade 410, it is possible to specify a cause of the stoppage, and determine the optimum direction of restoration of the cutter blade 410 at the time of the re-start thereof, thereby minimizing adverse effects on the system. Although in the control flows shown in FIGS. 28 to 30, descriptions have been given of the cases in which half-cutting operations are carried out by the half-cutting means 400, this is not limitative, but the same control flows can be applied to cases in which full-cutting operations are carried out by the full-cutting means 300.

It is further understood by those skilled in the art that the foregoing are preferred embodiments of the invention, and that various changes and modifications may be made without departing from the spirit and scope thereof.

What is claimed is:

1. A half-cutting device comprising:

a half cutter that has a cutter blade formed by an angular blade and moves in a direction of a width of a tape material to perform cutting operation on the tape material;

a tape reception plate opposed to said half cutter, with the tape material interposed therebetween, for receiving the tape material being cut; and a cutter actuating mechanism that causes said half cutter to perform a cyclic operation including a cutting preparation operation in which said half cutter is advanced toward said tape reception plate from a cutting wait position to a cutting start position, the cutting operation in which said half cutter is moved from the cutting start position to a position in which the cutting operation is completed, a withdrawing operation in which said half cutter is withdrawn from the position in which the cutting operation is completed to a withdrawn position, and a returning operation in which said half cutter is returned from the withdrawn position to the cutting wait position;

wherein said cutter actuating mechanism includes:

a first mechanism for causing said half cutter to carry out the cutting operation and the returning operation in a slidable manner;

a second mechanism for moving said half cutter to move toward and away from said tape reception plate to cause said half cutter to carry out the cutting preparation operation and the withdrawing operation; and a third mechanism for transmitting a driving force in a bifurcating manner to said first mechanism and said second mechanism to thereby cause said first mechanism and said second mechanism to operate in an interlocked manner;

wherein said first mechanism includes:

a guide shaft arranged in parallel with a tape-receiving surface of said tape reception plate for slidably holding said half cutter; and an input arm having an end portion thereof connected to said half cutter and at the same time capable of performing swinging motion about a root portion thereof, said input arm being supplied with a portion of the driving force from said third mechanism, for performing the swinging motions, and causing said half cutter to slide such that said half cutter is guided by said guide shaft; and a frame member; and wherein said second mechanism includes:

a support block supporting said guide shaft and at the same time mounted on said frame member such that said support block is capable of advancing and withdrawing, and an input plate having one end thereof connected to said support block and another end rotatably connected to said frame member, said input plate being supplied with a portion of the driving force from said third mechanism, thereby causing said guide shaft to approach and withdraw, via said support block.

2. A half-cutting device according to claim 1, wherein said input arm is formed with a cranking slot, wherein said input plate is formed with an engaging protrusion, wherein said third mechanism includes:

a rotary disk being driven for rotation by the portion of the driving force supplied from a drive source, a crank protrusion formed an one end face of said rotary disk, and an end face cam groove formed in another end face of said rotary disk, and wherein said crank protrusion performing a rotary motion in accordance with rotation of said rotary disk engages with the cranking slot formed in said input arm to form a swinging cranking mechanism in cooperation with said input arm, and wherein said end face cam groove engages with the engaging protrusion formed on said input plate, to form an end Lace cam mechanism in cooperation with said input plate.

3. A half-cutting device comprising:

a half cutter that has a cutter blade formed by an angular blade and moves in a direction of a width of a tape material to perform cutting operation on the tape material;

a tape reception plate opposed to said half cutter, with the tape material interposed therebetween, for receiving the tape material being cut; and a cutter actuating mechanism that causes said half cutter to perform a cyclic operation including a cutting preparation operation in which said half cutter is advanced toward said tape reception plate from a cutting wait position to a cutting start position, the cutting operation in which said half cutter is moved from the cutting start position to a position in which the cutting operation is completed, a withdrawing operation in which said half cutter is withdrawn from the position in which the cutting operation is completed to a withdrawn position, and a returning operation in which said half cutter is returned from the withdrawn position to the cutting wait position;

wherein said cutter actuating mechanism includes:

a first mechanism for causing said half cutter to carry out the cutting operation and the returning operation in a slidable manner;

a second mechanism for moving said half cutter to move toward and away from said tape reception plate to cause said half cutter to carry out the cutting preparation operation and the withdrawing operation; and a third mechanism for transmitting a driving force in a bifurcating manner to said first mechanism and said second mechanism to thereby cause said first mechanism and said second mechanism to operate in an interlocked manner;

wherein said first mechanism includes:

a guide shaft arranged in parallel with a tape-receiving surface of said tape reception plate for slidably holding said half cutter; and an input arm having an end portion thereof connected to said half cutter and at the same time capable of performing swinging motion about a root portion thereof, said input arm being supplied with a portion of the driving force from said third mechanism, for performing the swinging motions, and causing said half cutter to slide such that said half cutter is guided by said guide shaft; and wherein a sliding area extending along said guide shaft, on which said half cutter slides, is surrounded by a cutter cover such that the cutter cover covers the sliding area.

4. A half-cutting device according to claim 3, wherein the cutter cover is formed with a slit, for permitting a connecting portion connecting between said half cutter and said input arm to slide along said guide shaft.

5. A half-cutting device according to claim 3, wherein the cutter cover has a portion formed on a side thereof toward said tape reception plate to prevent the tape material from entering the slide area.

6. A half-cutting device according to claim 3, wherein the cutter cover includes a cutter blade-protecting portion protruding toward said tape-receiving member such that the cutter blade-protecting portion overlaps the cutter blade of said half cutter in the cutting wait position.

7. A hall-cutting device according to claim 6, wherein said tape reception plate is formed with an escape hole for allowing an end portion of the cutter blade-protecting portion to enter therein.

* * * * *